US007665534B2

(12) United States Patent
Heller et al.

(10) Patent No.: US 7,665,534 B2
(45) Date of Patent: Feb. 23, 2010

(54) ZONE ISOLATION ASSEMBLY FOR ISOLATING AND TESTING FLUID SAMPLES FROM A SUBSURFACE WELL

(75) Inventors: Noah R. Heller, Corte Madera, CA (US); Peter F. Moritzburke, Corte Madera, CA (US)

(73) Assignee: Besst, Inc., San Rafael, CA (US)

( * ) Notice: Subject to any disclaimer, the term of this patent is extended or adjusted under 35 U.S.C. 154(b) by 114 days.

(21) Appl. No.: 11/651,900

(22) Filed: Jan. 9, 2007

(65) Prior Publication Data

US 2007/0158062 A1 Jul. 12, 2007

Related U.S. Application Data

(60) Provisional application No. 60/758,030, filed on Jan. 11, 2006, provisional application No. 60/765,249, filed on Feb. 3, 2006.

(51) Int. Cl.
*E21B 33/10* (2006.01)

(52) U.S. Cl. ..... 166/382; 166/68; 166/105

(58) Field of Classification Search ..... 166/264, 166/382, 386, 68, 69, 105
See application file for complete search history.

(56) References Cited

U.S. PATENT DOCUMENTS

| | | | | |
|---|---|---|---|---|
| 2,128,253 | A | 8/1938 | Johnson | |
| 2,137,296 | A | 11/1938 | Macready | |
| 2,190,250 | A | 2/1940 | Blackburn | |
| 2,227,539 | A | 1/1941 | Dorton | |
| 2,776,013 | A | 1/1957 | Tausch | |
| 2,946,387 | A | 7/1960 | Hooker | |
| 3,022,828 | A * | 2/1962 | Hodges | 166/115 |
| 3,152,639 | A | 10/1964 | Pearcy | |
| 3,969,937 | A | 7/1976 | Barrington et al. | |
| 4,475,595 | A | 10/1984 | Watkins et al. | |

(Continued)

OTHER PUBLICATIONS

U.S. Appl. No. 11/178,055, filed Jul. 8, 2005, entitled "Systems and Methods for Installation, Design and Operation of Groundwater Monitoring Systems in Boreholes".

(Continued)

*Primary Examiner*—Shane Bomar
(74) *Attorney, Agent, or Firm*—Roeder & Broder LLP; James P. Broder

(57) ABSTRACT

A zone isolation assembly (22) for a subsurface well (12) having a surface region (32), a first zone (26) and a second zone (28) includes a docking receiver (48) and a docking apparatus (50). The docking apparatus (50) is selectively moved relative to the docking receiver (48) between a disengaged position and an engaged position. In the disengaged position, the first zone (26) is in fluid communication with the second zone (28). In the engaged position, the first zone (26) is not in fluid communication with the second zone (28) during movement of a fluid between the first zone (26) and the surface region (32). The docking apparatus (50) can be maintained in the engaged position substantially by a force of gravity. The zone isolation assembly (22) can include a pump assembly (54) that pumps the fluid while the docking apparatus (50) is in the engaged position. The zone isolation assembly (22) can include a fluid collector (52) that collects the fluid when the docking apparatus (50) is in the engaged position.

67 Claims, 21 Drawing Sheets

U.S. PATENT DOCUMENTS

| | | | | |
|---|---|---|---|---|
| 4,489,779 | A | 12/1984 | Dickinson | |
| 4,701,107 | A | 10/1987 | Dickinson | |
| 4,942,923 | A | 7/1990 | Geeting | |
| 4,995,456 | A | 2/1991 | Cornette et al. | |
| 5,293,931 | A | 3/1994 | Nichols et al. | |
| 5,293,934 | A | 3/1994 | Burge et al. | |
| 5,450,900 | A | 9/1995 | Schalla et al. | |
| 5,473,939 | A | 12/1995 | Leder et al. | |
| 5,687,791 | A | 11/1997 | Beck et al. | |
| 5,708,220 | A | 1/1998 | Burge | |
| 5,829,520 | A | 11/1998 | Johnson | |
| 5,909,773 | A | 6/1999 | Koehler et al. | |
| 6,158,516 | A | 12/2000 | Smith et al. | |
| 6,301,959 | B1 | 10/2001 | Hrametz et al. | |
| 6,508,310 | B1 * | 1/2003 | Mioduszewski et al. | 166/373 |
| 6,619,931 | B2 | 9/2003 | Anderson | |
| 6,668,943 | B1 | 12/2003 | Maus et al. | |
| 6,722,432 | B2 | 4/2004 | Spiers et al. | |
| 6,745,835 | B2 | 6/2004 | Fields | |
| 6,935,356 | B2 | 8/2005 | Shepard et al. | |
| 7,004,252 | B2 | 2/2006 | Vise, Jr. | |
| 7,111,682 | B2 | 9/2006 | Blaisdell et al. | |
| 7,320,364 | B2 * | 1/2008 | Fairbanks | 166/302 |
| 7,461,547 | B2 * | 12/2008 | Terabayashi et al. | 73/152.55 |
| 2002/0053438 | A1 | 5/2002 | Williamson, Jr. | |
| 2002/0166663 | A1 | 11/2002 | Last et al. | |
| 2003/0127227 | A1 | 7/2003 | Fehr et al. | |
| 2004/0050548 | A1 | 3/2004 | Dybdahl | |
| 2004/0134663 | A1 | 7/2004 | Khomynets | |
| 2005/0028974 | A1 | 2/2005 | Moody | |
| 2005/0051329 | A1 | 3/2005 | Blaisdell | |
| 2005/0224229 | A1 | 10/2005 | Blacklaw | |
| 2007/0199691 | A1 * | 8/2007 | Heller et al. | 166/162 |

OTHER PUBLICATIONS

San Diego Plastics, Inc., http://www.sdplastics.com/pvc.html, Jan. 21, 1997. Web page unavailable.

International Search Report, PCT/US07/00683 (relevant page).

* cited by examiner

ZONE ISOLATION ASSEMBLY FOR ISOLATING AND TESTING FLUID SAMPLES FROM A SUBSURFACE WELL

RELATED APPLICATIONS

This Application claims the benefit on U.S. Provisional Application Ser. No. 60/758,030 filed on Jan. 11, 2006, and on U.S. Provisional Application Ser. No. 60/765,249 filed on Feb. 3, 2006. The contents of U.S. Provisional Application Ser. Nos. 60/758,030 and 60/765,249 are incorporated herein by reference.

BACKGROUND

Subsurface wells for extracting and/or testing fluid (liquid or gas) samples on land and at sea have been used for many years. Many structures have been developed in an attempt to isolate the fluid from a particular depth in a well so that more accurate in situ or remote laboratory testing of the fluid at that depth "below ground surface" (bgs) can be performed. Unfortunately, attempts to accurately and cost-effectively accomplish this objective have been not altogether satisfactory.

For example, typical wells include riser pipes have relatively large diameters, i.e. 2-4 inches, or greater. Many such wells can have depths that extend hundreds or even thousands of feet bgs. In order to accurately remove a fluid sample from a particular target zone within a well, such as a sample at 1,000 feet bgs, typical wells require that the fluid above the target zone be removed at least once, and more commonly 3 to 5 times this volume, in order to obtain a more representative fluid sample from the desired level. From a volumetric standpoint, traditional wet casing volumes of 2-inch and 4-inch monitoring wells are 0.63 liters (630 ml) to 2.5 liters (2,500 ml) per foot, respectively. As an example, to obtain a sample at 1,000 feet bgs, approximately 630 liters to 2,500 liters of fluid must be purged from the well at least once and more commonly as many as 3 to 5 times this volume. The time required and costs associated with extracting this fluid from the well can be rather significant.

One method of purging fluid from the well and/or obtaining a fluid sample includes using coaxial gas displacement within the riser pipe of the well. Unfortunately, this method can have several drawbacks. First, gas consumption during pressurization of these types of systems can be relatively substantial because of the relatively large diameter and length of riser pipe that must be pressurized. Second, introducing large volumes of gas into the riser pipe can potentially have adverse effects on the volatile organic compounds (VOC's) being measured in the fluid sample that is not collected properly. Third, a pressure sensor that may be present within the riser pipe of a typical well is subjected to repeated pressure changes from the coaxial gas displacement pressurization of the riser pipe. Over time, this artificially-created range of pressures in the riser pipe may have a negative impact on the accuracy of the pressure measurements from the sensor. Fourth, residual gas pressure can potentially damage one or more sensors and/or alter readings from the sensors once substantially all of the fluid has passed through the sample collection line past the sensors. Fifth, any leaks in the system can cause gas to be forcibly infused into the ground formation, which can influence the results of future sample collections.

Another method for purging fluid from these types of wells includes the use of a bladder pump. Bladder pumps include a bladder that alternatingly fills and empties with a gas to force movement of the fluid within a pump system. However, the bladders inside these pumps can be susceptible to leakage due to becoming fatigued or detached during pressurization. Further, the initial cost as well as maintenance and repair of bladder pumps can be relatively expensive. In addition, at certain depths, bladder pumps require an equilibration period during pressurization to decrease the likelihood of damage to or failure of the pump system. This equilibration period can result in a slower overall purging process, which decreases efficiency.

An additional method for purging fluid from a well includes using an electric submersible pump system having an electric motor. This type of system can be susceptible to electrical shorts and/or burning out of the electric motor. Additionally, this type of pump typically uses one or more impellers that can cause pressure differentials (e.g., drops), which can result in VOC loss from the sample being collected. Operation of these types of electric pumps can also raise the temperature of the groundwater, which can also impact VOC loss. Moreover, these pumps can be relatively costly and somewhat more difficult to repair and maintain.

Further, the means for physically isolating a particular zone of the well from the rest of the well can have several shortcomings. For instance, inflatable packers are commonly used to isolate the fluid from a particular zone either above or below the packer. However, these types of packers can be subject to leakage, and can be cumbersome and relatively expensive. In addition, these packers are susceptible to rupturing, which potentially damage the well.

SUMMARY

The present invention is directed toward a zone isolation assembly for a subsurface well that extends downward from a surface region. The subsurface well includes (i) a first fluid inlet structure that at least partially defines a first zone that receives a first fluid, and (ii) a second zone that is nearer to the surface region than the first zone. In one embodiment, the zone isolation assembly includes a fixed docking receiver and a docking apparatus. The docking receiver is coupled to the first fluid inlet structure. Further, the docking receiver at least partially defines the first zone. In this embodiment, the docking apparatus is selectively moved relative to the docking receiver between a disengaged position and an engaged position. In the disengaged position, the first zone is in fluid communication with the second zone. In the engaged position, the docking apparatus engages the docking receiver so that the first zone is not substantially in fluid communication with, or is completely isolated from, the second zone during movement of the first fluid between the first zone and the surface region. The docking apparatus can include a resilient seal that forms a substantially fluid-tight seal with the docking receiver when the docking apparatus is in the engaged position.

In certain embodiments, the docking apparatus is maintained in the engaged position substantially by a force of gravity. In alternative embodiments, the zone isolation assembly can also include a pump assembly that is coupled to the docking apparatus. The pump assembly can pump the first fluid out of the first zone while the docking apparatus is in the engaged position. In some embodiments, the pump assembly is positioned substantially within the first zone while the docking apparatus is in the engaged position. Alternatively, the pump assembly can be positioned substantially within the second zone while the docking apparatus is in the engaged position. Further, the subsurface well includes a riser pipe that at least partially defines the second zone. In certain embodiments, the pump assembly is removable from the riser pipe. In one embodiment, the subsurface well includes a gas inlet line that guides movement of a gas to the pump assembly, and a fluid outlet line that guides movement of the first fluid toward the surface region. In this embodiment, the gas does not contact the first fluid while the first fluid is in the fluid outlet line.

In certain embodiments, the zone isolation assembly can include a fluid collector that is coupled to the docking apparatus. The fluid collector can collect the first fluid for transport to the surface region. In some embodiments, the fluid collector is positioned within the first zone during collection of the portion of the first fluid. The fluid collector can include a perforated sipping tube, a passive diffusion sampling apparatus, or a pressurizable bailer, as non-exclusive examples.

In some embodiments, the zone isolation assembly can also include a substantially fluid-tight manifold that selectively inhibits a fluid from entering into the second zone through the surface region.

In another embodiment, the zone isolation assembly can include a fluid disperser that is at least partially positioned in the first zone. In this embodiment, the fluid disperser can disperse a dispersion fluid (such as a remediation or tracer fluid) from the surface region into the first zone while the docking apparatus is in the engaged position.

The subsurface well can also include a second fluid inlet structure that allows a second fluid to enter the second zone without contacting the first fluid when the docking apparatus is in the engaged position.

The present invention is also directed toward a fluid monitoring system including the zone isolation assembly and a fluid property sensor. The fluid property sensor can sense one or more fluid properties, including electrical properties, optical properties, acoustical properties, chemical properties and/or hydraulic properties.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
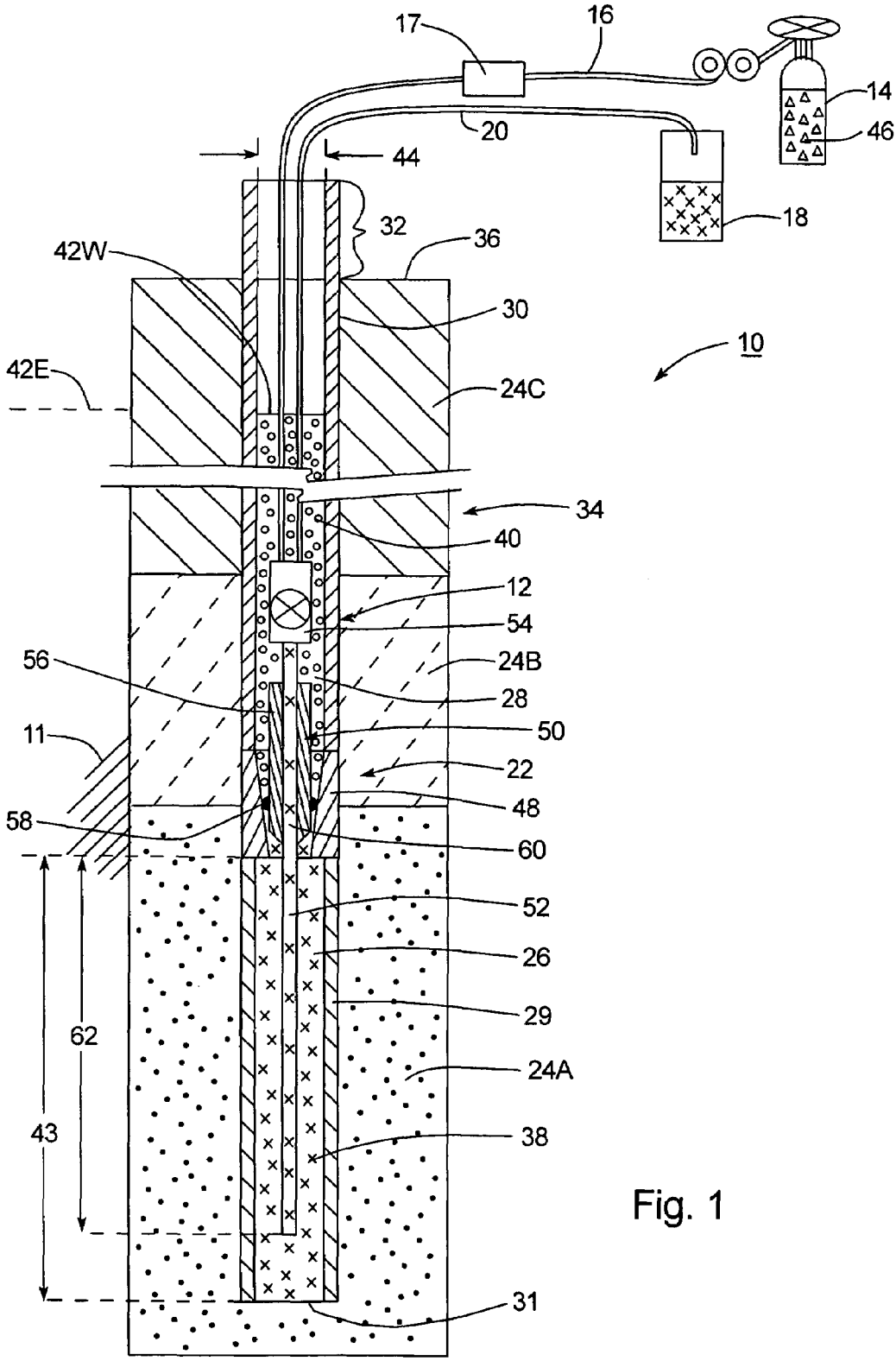
FIG. 1 is a cross-sectional view of one embodiment of a fluid monitoring system having features of the present invention, including one embodiment of a zone isolation assembly.

FIG. 1 is a schematic view of one embodiment of a fluid monitoring system 10 for monitoring one or more parameters of subsurface fluid from an adjacent environment 11. As used herein, the term "environment" can include naturally occurring or artificial (manmade) environments 11 of either solid or liquid materials. As non-exclusive examples, the environment 11 can include a ground formation of soil, rock or any other types of solid formations, or the environment 11 can include a portion of a body of water (ocean, lake, river, etc.) or other liquid regions.

Monitoring the fluid in accordance with the present invention can be performed in situ or following removal of the fluid from its native or manmade environment 11. As used herein, the term "monitoring" can include a one-time measurement of a single parameter of the fluid, multiple or ongoing measurements of a single parameter of the fluid, a one-time measurement of multiple parameters of the fluid, or multiple or ongoing measurements of multiple parameters of the fluid. Further, it is recognized that subsurface fluid can be in the form of a liquid and/or a gas. In addition, the Figures provided herein are not to scale given the extreme heights of the fluid monitoring systems relative to their widths.

The fluid monitoring system 10 illustrated in FIG. 1 can include a subsurface well 12, a gas source 14, a gas inlet line 16, a controller 17, a fluid receiver 18, a fluid outlet line 20 and a zone isolation assembly 22. In this embodiment, the subsurface well 12 (also sometimes referred to herein simply as "well") includes one or more layers of annular materials 24A, 24B, 24C, a first zone 26, a second zone 28, a fluid inlet structure 29, and a riser pipe 30. It is understood that although the fluid monitoring systems 10 described herein are particularly suited to be installed in the ground, various embodiments of the fluid monitoring systems 10 are equally suitable for installation and use in a body of water, or in a combination of both ground and water, and that no limitations are intended in any manner in this regard.

The subsurface well 12 can be installed using any one of a number of methods known to those skilled in the art. In non-exclusive, alternative examples, the well 12 can be installed with hollow stem auger, sonic, air rotary casing hammer, dual wall percussion, dual tube, rotary drilling, vibratory direct push, cone penetrometer, cryogenic, ultrasonic and/or laser methods, or any other suitable method known to those skilled in the art of drilling and/or well placement. The wells 12 described herein include a surface region 32 and a subsurface region 34. The surface region 32 is an area that includes the top of the well 12 which extends to a surface 36. Stated another way, the surface region 32 includes the portion of the well 12 that extends between the surface 36 and the top of the riser pipe 30, whether the top of the riser pipe 30 is positioned above or below the surface 36. The surface 36 can either be a ground surface or the surface of a body of water or other liquid, as non-exclusive examples. The subsurface region 34 is the portion of the well 12 that is below the surface region 32, e.g., at a greater depth than the surface region 34.

The annular materials 24A-C can include a first layer 24A (illustrated by dots) that is positioned at or near the first zone 26, and a second layer 24B (illustrated by dashes) that is positioned at or near the second zone 28. The annular materials are typically positioned in layers 24A-C during installation of the well 12. It is recognized that although three layers 24A-C are included in the embodiment illustrated in FIG. 1, greater or fewer than three layers 24A-C of annular materials can be used in a given well 12.

In one embodiment, for example, the first layer 24A can be sand or any other suitably permeable material that allows fluid to move from the surrounding ground environment 11 to the fluid inlet structure 29 of the well 12. The second layer 24B is positioned above the first layer 24A. The second layer 24B can be formed from a relatively impermeable layer that inhibits migration of fluid from the environment 11 near the fluid inlet structure 29 and the first zone 26 to the riser pipe 30 and the second zone 28. For example, the second layer 24B can include a bentonite material or any other suitable material of relative impermeability. In this embodiment, the second layer 28 helps increase the likelihood that the fluid collected through the fluid inlet structure 29 of the well 12 is more representative of the fluid from the environment 11 adjacent to the fluid inlet structure 29. The third layer 24C is positioned above the second layer 24B and can be formed from any suitable material, such as backfilled grout, bentonite, volclay and/or native soil, as one non-exclusive example. The third layer 24C is positioned away from the first layer 24A to the extent that the likelihood of fluid migrating from the environment 11 near the third layer 24C down to the fluid inlet structure 29 is reduced or prevented.

As used herein, the first zone 26 is a target zone from which a particular fluid sample is desired to be taken and/or monitored. Further, the second zone 28 can include fluid that is desired to be excluded from the fluid sample to be removed from the well 12 and/or tested, and is adjacent to the first zone 26. In the embodiments provided herein, the first zone 26 is positioned either directly beneath or at an angle below the second zone 28 such that the first zone 26 is further from the surface 36 of the surface region 32 than the second zone 28.

In each well 12, the first zone 26 has a first volume and the second zone 28 has a second volume. In certain embodiments, the second volume is substantially greater than the first volume because the height of the second zone 28 can be substantially greater than a height of the first zone 26. For example, the height of the first zone 26 can be on the order of between several inches to five or ten feet. In contrast, the height of the second zone 28 can be from several feet up to several hundreds or thousands of feet. Assuming somewhat similar inner dimensions of the first zone 26 and the second zone 28, the second volume can be from 100% to 100,000% greater than the first volume. As one non-exclusive example, in a 1-inch inner diameter well 12 having a depth of 1,000 feet, with the first zone 26 positioned at the bottom of the well 12, the first zone having a height of approximately five feet, the second zone 28 would have a height of approximately 995 feet. Thus, the first volume would be approximately 47 $in^3$, while the second volume would be approximately 9,378 $in^3$, or approximately 19,800% greater than the first volume.

For ease in understanding, the first zone 26 includes a first fluid 38 (illustrated with X's), and the second zone 28 includes a second fluid 40 (illustrated with O's). The first fluid 38 and the second fluid 40 migrate as a single fluid to the well 12 through the environment 11 outside of the fluid inlet structure 29. In this embodiment, a well fluid level 42W in the well 12 is the top of the second fluid 40, which, at equilibrium, is approximately equal to an environmental fluid level 42E in the environment 11, although it is acknowledged that some differences between the well fluid level 42W and the environmental fluid level 42E can occur. During equilibration of the fluid levels 42W, 42E, the fluid rises in the first zone 26 and the second zone 28 of the well 12. Due to gravitational forces and/or other influences, the fluid near an upper portion (e.g., in the second zone 28) of the well 12 will have a different composition from the fluid near a lower portion (e.g., in the first zone 26) of the well 12. Thus, although the first fluid 38 and the second fluid 40 can originate from a somewhat similar location within the environment 11, the first fluid 38 and the second fluid 40 can ultimately have different compositions at a point in time after entering the well 12, based on the relative positions of the fluids 38, 40 within the well 12.

The first fluid 38 is the liquid or gas that is desired for monitoring and/or testing. In this and other embodiments, it is desirable to inhibit mixing or otherwise commingling of the first fluid 38 and the second fluid 40 before monitoring and/or testing the first fluid 38. As described in greater detail below, the first fluid 38 and the second fluid 40 can be effectively isolated from one another utilizing the zone isolation assembly 22.

The fluid inlet structure 29 allows fluid from the first layer 24A outside the first zone 26 to migrate into the first zone 26. The design of the fluid inlet structure 29 can vary. For example, the fluid inlet structure 29 can have a substantially tubular configuration or another suitable geometry. Further, the fluid inlet structure 29 can be perforated, slotted, screened or can have some other alternative openings or pores (not shown) that allow fluid and/or various particulates to enter into the first zone 26. The fluid inlet structure 29 can include an end cap 31 at the lowermost end of the fluid inlet structure 29 that inhibits material from the first layer 24A from entering the first zone 26.

The fluid inlet structure 29 has a length 43 that can vary depending upon the design requirements of the well 12 and the subsurface monitoring system 10. For example, the length 43 of the fluid inlet structure 29 can be from a few inches to several feet or more.

The riser pipe 30 is a hollow, cylindrically-shaped structure. The riser pipe 30 can be formed from any suitable materials. In one non-exclusive embodiment, the riser pipe 30 can be formed from a polyvinylchloride (PVC) material and can be any desired thickness, such as Schedule 80, Schedule 40, etc. Alternatively, the riser pipe 30 can be formed from other plastics, fiberglass, ceramic, metal, etc. The length (oriented substantially vertically in FIG. 1) of the riser pipe 30 can vary depending upon the requirements of the system 10. For example, the length of the riser pipe 30 can be within the range of a few feet to thousands of feet, as necessary. It is recognized that although the riser pipe 30 illustrated in the Figures is illustrated substantially vertically, the riser pipe 30 and other structures of the well 12 can be positioned at any suitable angle from vertical.

The inner diameter 44 of the riser pipe 30 can vary depending upon the design requirements of the well 12 and the fluid monitoring system 10. In one embodiment, the inner diameter 44 of the riser pipe 30 is less than approximately 2.0 inches. For example, the inner diameter 44 of the riser pipe 30 can be approximately 1.85 inches. In non-exclusive alternative embodiments, the inner diameter 44 of the riser pipe 30 can be approximately 1.40 inches, 0.90 inches, 0.68 inches, or any other suitable dimension. In still other embodiments, the inner diameter 44 of the riser pipe 30 can be greater than 2.0 inches.

The gas source 14 includes a gas 46 (illustrated with small triangles) that is used to move the first fluid 38 as provided in greater detail below. The gas 46 used can vary. For example, the gas 46 can include nitrogen, argon, oxygen, helium, air, hydrogen, or any other suitable gas. In one embodiment, the flow of the gas 46 can be regulated by the controller 17, which can be manually or automatically operated and controlled, as needed.

The gas inlet line 16 is a substantially tubular line that directs the gas 46 to the well 12 or to various structures and/or locations within the well 12, as described in greater detail below.

The controller 17 can control or regulate various processes related to fluid monitoring. For example, the controller 17 can adjust and/or control timing of the gas delivery to various structures within the well 12. Additionally, or alternatively, the controller 17 can adjust and/or regulate the volume of gas 46 that is delivered to the various structures within the well 12. In one embodiment, the controller 17 can include a computerized system. It is recognized that the positioning of the controller 17 within the fluid monitoring system 10 can be varied depending upon the specific processes being controlled by the controller 17. In other words, the positioning of the controller 17 illustrated in FIG. 1 is not intended to be limiting in any manner.

The fluid receiver 18 receives the first fluid 38 from the first zone 26 of the well 12. Once received, the first fluid 38 can be monitored and/or tested by methods known by those skilled in the art. Alternatively, the first fluid 38 can be monitored and/or tested prior to being received by the fluid receiver 18. The first fluid 38 is transferred to the fluid receiver 18 via the fluid outlet line 20. Alternatively, the fluid receiver 18 can receive a different fluid from another portion of the well 12.

The zone isolation assembly 22 selectively isolates the first fluid 38 in the first zone 26 from the second fluid 40 in the second zone 28. The design of the zone isolation assembly 22 can vary to suit the design requirements of the well 12 and the fluid monitoring system 10. In the embodiment illustrated in FIG. 1, the zone isolation assembly 22 includes a docking receiver 48, a docking apparatus 50, a fluid collector 52 and a pump assembly 54.

In the embodiment illustrated in FIG. 1, the docking receiver 48 is fixedly secured to the fluid inlet structure 29 and the riser pipe 30. In various embodiments, the docking receiver 48 is positioned between and threadedly secured to the fluid inlet structure 29 and the riser pipe 30. In non-exclusive alternative embodiments, the docking receiver 48 can be secured to the fluid inlet structure 29 and/or the riser pipe 30 in other suitable ways, such as by an adhesive material, welding, fasteners, or by integrally forming or molding the docking receiver 48 with one or both of the fluid inlet structure 29 and at least a portion of the riser pipe 30. Stated another way, the docking receiver 48 can be formed unitarily with the fluid inlet structure 29 and/or at least a portion of the riser pipe 30.

In certain embodiments, the docking receiver 48 is at least partially positioned at the uppermost portion of the first zone 26. In other words, a portion of the first zone 26 is at least partially bounded by the docking receiver 48. Further, the docking receiver 48 can also be positioned at the lowermost portion of the second zone 28. In this embodiment, a portion of the second zone 28 is at least partially bounded by the docking receiver 48.

The docking apparatus 50 selectively docks with the docking receiver 48 to form a substantially fluid-tight seal between the docking apparatus 50 and the docking receiver 48. The design and configuration of the docking apparatus 50 as provided herein can be varied to suit the design requirements of the docking receiver 48. In various embodiments, the docking apparatus 50 moves from a disengaged position wherein the docking apparatus 50 is not docked with the docking receiver 48, to an engaged position wherein the docking apparatus 50 is docked with the docking receiver 48.

In the disengaged position, the first fluid 38 and the second fluid 40 are not isolated from one another. In other words, the first zone 26 and the second zone 28 are in fluid communication with one another. In the engaged position (illustrated in FIG. 1), the first fluid 38 and the second fluid 40 are isolated from one another. Stated another way, in the engaged position, the first zone 26 and the second zone 28 are not in fluid communication with one another.

The docking apparatus 50 includes a docking weight 56, a resilient seal 58 and a fluid channel 60. In various embodiments, the docking weight 56 has a specific gravity that is greater than water. In non-exclusive alternative embodiments, the docking weight 56 can be formed from materials so that the docking apparatus has an overall specific gravity that is at least approximately 1.50, 2.00, 2.50, 3.00, or 4.00. In certain embodiments, the docking weight 56 can be formed from materials such as metal, ceramic, epoxy resin, rubber, nylon, Teflon, Nitrile, Viton, glass, plastic or other suitable materials having the desired specific gravity characteristics.

In various embodiments, the resilient seal 58 is positioned around a circumference of the docking weight 56. The resilient seal 58 can be formed from any resilient material such as rubber, urethane or other plastics, certain epoxies, or any other material that can form a substantially fluid-tight seal with the docking receiver 48. In one non-exclusive embodiment, for example, the resilient seal 58 is a rubberized O-ring. In this embodiment, because the resilient seal 58 is in the form of an O-ring, a relatively small surface area of contact between the resilient seal 58 and the docking receiver 48 occurs. As a result, a higher force in pounds per square inch (psi) is achieved. For example, a fluid-tight seal between the docking receiver 48 and the resilient seal 58 can be achieved with a force that is less than approximately 1.00 psi. In non-exclusive alternative embodiments, the force can be less than approximately 0.75, 0.50, 0.40 or 0.33 psi. Alternatively, the force can be greater than 1.00 psi or less than 0.33 psi.

The fluid channel 60 can be a channel or other type of conduit for the first fluid 38 to move through the docking weight 56, in a direction from the fluid collector 52 toward the pump assembly 54. In one embodiment, the fluid channel 60 can be tubular and can have a substantially circular cross-section. Alternatively, the fluid channel 60 can have another suitable configuration. The positioning of the fluid channel 60 within the docking weight 56 can vary. In one embodiment, the fluid channel 60 can be generally centrally positioned within the docking weight 56 so that the first fluid 38 flows substantially centrally through the docking weight 56. Alternatively, the fluid channel 60 can be positioned in an off-center manner. In certain embodiments, the fluid channel 60 effectively extends from the docking weight 56 to the pump assembly 54.

The docking apparatus 50 can be lowered into the well 12 from the surface region 32. In certain embodiments, the docking apparatus 50 utilizes the force of gravity to move down the riser pipe 30, through any fluid present in the riser pipe 30 and into the engaged position with the docking receiver 48. Alternatively, the docking apparatus 50 can be forced down the riser pipe 30 and into the engaged position by another suitable means.

The docking apparatus 50 is moved from the engaged position to the disengaged position by exerting a force on the docking apparatus 50 against the force of gravity, such as by pulling in a substantially upward manner, e.g., in a direction from the docking receiver 48 toward the surface region 32, on a tether or other suitable line coupled to the docking apparatus 50 to break or otherwise disrupt the seal between the resilient seal 58 and the docking receiver 48.

The fluid collector 52 collects the first fluid 38 from the first zone 26 for transport of the first fluid 38 toward the surface region 32. The design of the fluid collector 52 can vary depending upon the requirements of the subsurface monitoring system 10. In the embodiment illustrated in FIG. 1, the fluid collector 52 is secured to the docking apparatus 50 and extends in a downwardly direction into the first zone 26 when the docking apparatus is in the engaged position. In the embodiment illustrated in FIG. 1, the fluid collector 52 is a perforated sipping tube that receives the first fluid 38 from the first zone 26. As provided previously, when the docking apparatus 50 is in the engaged position with the docking receiver 48, the first zone 26 is isolated from the second zone 28. Thus, because the fluid collector 52 is positioned within the first zone 26, in the engaged position, the fluid collector 52 only collects the first fluid 38.

The fluid collector 52 has a length 62 that can be varied to suit the design requirements of the first zone 26 and the fluid monitoring system 10. In certain embodiments, the fluid collector 52 extends substantially the entire length 43 of the fluid inlet structure 29. Alternatively, the length 62 of the fluid collector 52 can be any suitable percentage of the length 43 of the fluid inlet structure 29.

The pump assembly 54 pumps the first fluid 38 that enters the pump assembly 54 to the fluid receiver 18 via the fluid outlet line 20. The design and positioning of the pump assembly 54 can vary. In one embodiment, the pump assembly 54 is a highly robust, miniaturized low flow pump that can easily fit into a relatively small diameter wells 12, such as a 1-inch or ¾-inch riser pipe 30, although the pump assembly 54 is also adaptable to be used in larger diameter wells 12.

In the embodiment illustrated in FIG. 1, the pump assembly 54 can include one or more one-way valves (not shown in FIG. 1) such as those found in a single valve parallel gas displacement pump, double valve pump, bladder pump, electric submersible pump and/or other suitable pumps, that are utilized during pumping of the first fluid 38 to the fluid receiver 18. The one way valve(s) allow the first fluid 38 to move from the first zone 26 toward the fluid outlet line 20, without the first fluid 38 moving in the opposite direction. These types of one-way valves can include poppet valves, reed valves, electronic valves, electromagnetic valves and/or check valves, for example. The gas inlet line 16 extends to the pump assembly 54, and the fluid outlet line 20 extends from the pump assembly 54. In this embodiment, because the environmental fluid level 42E is above the level of the fluid collector 52, the level of the first fluid 38 equilibrates at a somewhat similar level within the fluid outlet line 20 (as well as the gas inlet line 16) as the environmental fluid level 42E, until such time as the first fluid 38 is pumped or otherwise transported toward the surface region 32.

As explained in greater detail below, gas 46 from the gas source 14 is delivered down the gas inlet line 16 to the pump assembly 54 to force the first fluid 38 that has migrated to the pump assembly 54 during equilibration upward through the fluid outlet line 20 to the fluid receiver 18. With this design, the gas 46 does not cause any pressurization of the riser pipe 30, nor does the gas 46 utilize the riser pipe 30 during the pumping process. Stated another way, in this and other embodiments, the riser pipe 30 does not form any portion of the pump assembly 54. With this design, the need for high-pressure riser pipe 30 is reduced or eliminated. Further, gas consumption is greatly reduced because the riser pipe 30, which has a relatively large volume, need not be pressurized.

The pump assembly 54 can be coupled to the docking apparatus 50 so that removal of the docking apparatus 50 from the well 12 likewise results in simultaneous removal of the pump assembly 54 (and the fluid collector 52) from the well 12.

In an alternative embodiment, the pump assembly 54 can be incorporated as part of the docking apparatus 50 within a single structure. In this embodiment, the docking apparatus 50 can house the pump assembly 54, thereby obviating the need for two separate structures (docking apparatus 50 and pump assembly 54) that are illustrated in FIG. 1. Instead, in this embodiment, only one structure would be used which would serve the purposes described herein for the docking apparatus 50 and the pump assembly 54. In one embodiment, the pump assembly 54 can have both the shape and the weight of the docking apparatus 50 so that the pump assembly 54 can be positioned in the engaged position relative to the docking receiver 48.

In operation, following installation of the well 12, fluid from the environment enters the first zone 26 through the fluid inlet structure 29. Before the docking apparatus 50 is in the engaged position, the first zone 26 and the second zone 28 are in fluid communication with one another, thereby allowing the fluid to flow upwards and mix into the second zone while the fluid level is equilibrating within the well 12.

During a monitoring, sampling or testing process, the docking apparatus 50 is lowered into the well 12 down the riser pipe 30 until the docking apparatus 50 engages with the docking receiver 48. The resilient seal 58 forms a fluid-tight seal with the docking receiver 48 so that the first zone 26 and the second zone 28 are no longer in fluid communication with one another. At this point the fluid within the well becomes separated into the first fluid 38 and the second fluid 40.

In the embodiment illustrated in FIG. 1, the fluid collector 52 begins collecting the first fluid 38, resulting in a raising of the first fluid 38 upwards from the fluid collector 52 toward the pump assembly 54, depending upon the environmental fluid level 42E. The first fluid 38 remains isolated from the second fluid 40 during this process since the pump assembly 54 is self-contained and does not rely on the riser pipe 30 as part of the structure of the pump assembly 54 in any way.

The controller 17 (or an operator of the system) can commence the flow of gas 46 to the pump assembly 54 to begin pumping the first fluid 38 through the fluid outlet line 20 to the fluid receiver 18, as described in greater detail below. Once the first fluid 38 has been substantially purged from the first zone 26, the controller 17 can stop the flow of gas 46, which effectively stops the pumping process. The first zone 26 can then refill with more fluid from the environment 11, which can then be monitored, analyzed and/or removed for further testing as needed. Alternatively, the process of purging the fluid can be immediately followed by sampling the fluid 38, with the controller 17 being in continuous operation.

Because the volume of the first zone 26 is relatively small in comparison with the volume of the second zone 28, purging of the first fluid 38 from the first zone 26 occurs relatively rapidly. Further, because the first zone 26 is the sampling zone from which the first fluid 38 is collected, there is no need to purge or otherwise remove any of the second fluid 40 from the second zone 28. As long as the docking apparatus 50 remains in the engaged position, any fluid entering the first zone 26 will not be substantially influenced by or diluted with the second fluid 40.

Figure 2:
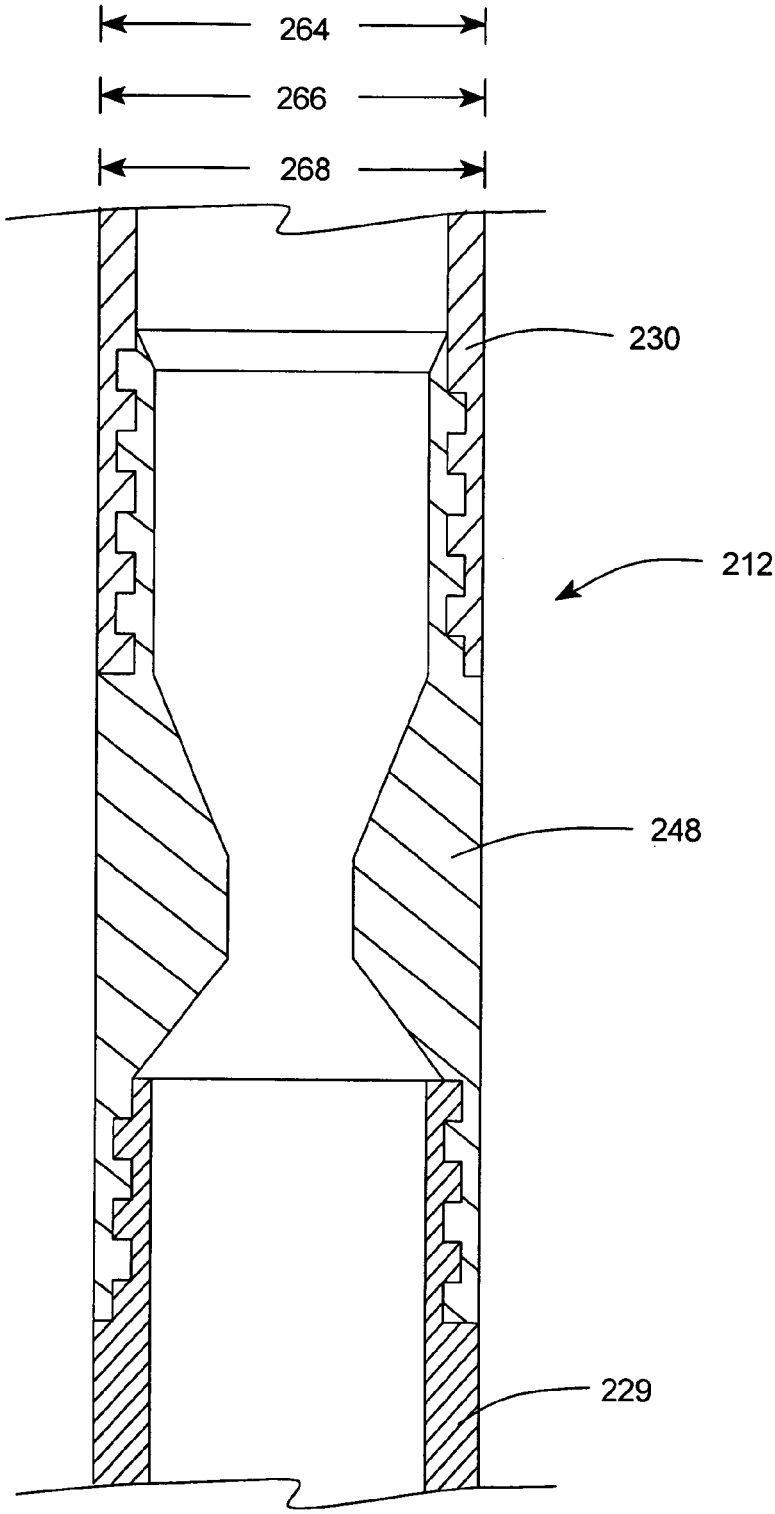
FIG. 2 is a cross-sectional view of a portion of one embodiment of a portion of the subsurface well, including a portion of a fluid inlet structure, a portion of a riser pipe and a docking receiver.

FIG. 2 is a detailed cross-sectional view of one embodiment of a portion of the subsurface well 212, including a portion of the fluid inlet structure 229, a portion of the riser pipe 230 and the docking receiver 248. In this embodiment, the docking receiver 248 is threadedly secured to the fluid inlet structure 229. Further, the riser pipe 230 is threadedly secured to the docking receiver 248. The docking receiver 248 is positioned between the fluid inlet structure 229 and the riser pipe 230. In alternative embodiments, the fluid inlet structure 229, the riser pipe 230 and/or the docking receiver 248 can be secured to one another by a different mechanism, such as by an adhesive material, welding, or any other suitable means. Still alternatively, the fluid inlet structure 229, the riser pipe 230 and/or the docking receiver 248 can be formed or molded as a unitary structure, which may or may not be homogeneous.

The fluid inlet structure 229 has an outer diameter 264, the riser pipe 230 has an outer diameter 266, and the docking receiver 248 has an outer diameter 268. In this embodiment, the outer diameters 264, 266, 268 are substantially similar so that the outer casing of the well 212 has a standard form factor and is relatively uniform for easier installation. Alternatively, the outer diameters 264, 266, 268 can be different from one another.

Figure 3A:
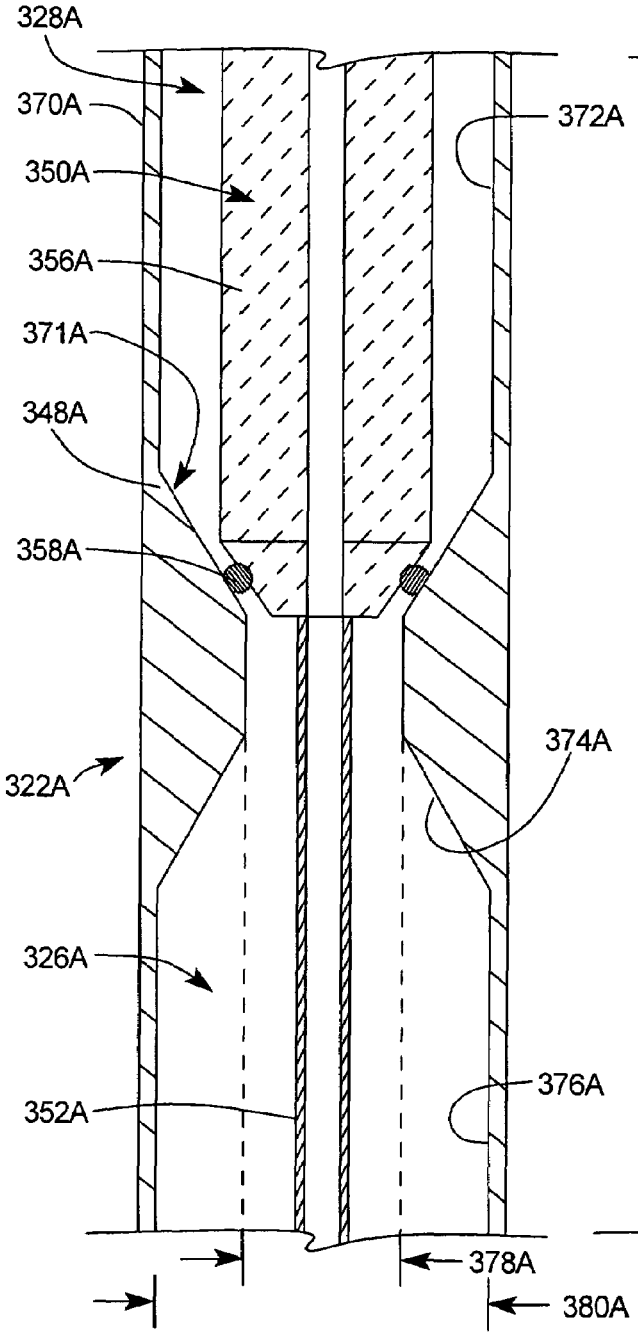
FIG. 3A is a cross-sectional view of a portion of an embodiment of the zone isolation assembly including a docking apparatus shown in an engaged position with a first embodiment of the docking receiver.

FIG. 3A is a cross-sectional view of a portion of an embodiment of the zone isolation assembly 322A including a docking apparatus 350A shown in the engaged position with a first embodiment of the docking receiver 348A. In this embodiment, the docking apparatus 350A includes the docking weight 356A and the resilient seal 358A. The force of gravity causes the docking weight 356A to impart a substantially downward force on the resilient seal 358A, which in turn, imparts a substantially downward force on the docking receiver 348A.

In one embodiment, the resilient seal 358A can be an O-ring. For example, the O-ring can be formed from a compressible material such as rubber, Viton, Nitrile, Teflon, plastic, epoxy, or any other suitable material that is compatible with the docking receiver 348A for forming a fluid-tight seal to maintain fluid isolation between the first zone 326A and the second zone 328A. Alternatively, the resilient seal 358A can have another suitable configuration that is different than an O-ring.

Because of the relatively small surface area of the O-ring or other similar resilient seal 358A that is in contact with the docking receiver 348A when the docking apparatus 350A is in the engaged position, and the relatively high specific gravity of the docking weight 356A, a higher force in terms of pounds per square inch (psi) is achieved between the resilient seal 358A and the docking receiver 348A. As a result, the likelihood of achieving a fluid-tight seal is increased or achieved, and the likelihood of fluid leakage between the docking receiver 348A and the docking apparatus 350A is reduced or eliminated. Additionally, because of the relatively high force between the resilient seal 358A and the docking receiver 348A, in various embodiments, the resilient seal 358A is not inflatable. In these embodiments, the force of gravity is substantial enough to maintain the required fluid-tight seal and maintain the docking apparatus 350A in the engaged position.

Further, in the embodiment illustrated in FIG. 3A, the docking receiver 348A has an exterior surface 370A and an interior surface 371A having a substantially linear upper section 372A, an hourglass-shaped intermediate section 374A and a substantially linear lower section 376A. In one embodiment, the upper section 372A and the lower section 376A of the interior surface 371A are substantially parallel with the exterior surface 370A. With this design, the docking apparatus 350A move easily upward or downward in the upper section 372A, and can firmly seat onto the intermediate section 374A of the docking receiver 348A when engaging with the docking receiver 348A.

The intermediate section 374A has an inner diameter 378A near the location of contact between the resilient seal 358A and the docking receiver 348A that is smaller than an inner diameter 380A of the lower section 376A. Stated another way, the inner diameter 378A of the intermediate section 374A increases moving in a direction from the point of contact between the resilient seal 358A toward the lower section 376A. With this design, the first zone 326A can hold a greater volume of the first fluid 38 (illustrated in FIG. 1). In addition, a greater spacing between the fluid collector 352A and the docking receiver 348A can be achieved.

Figure 3B:
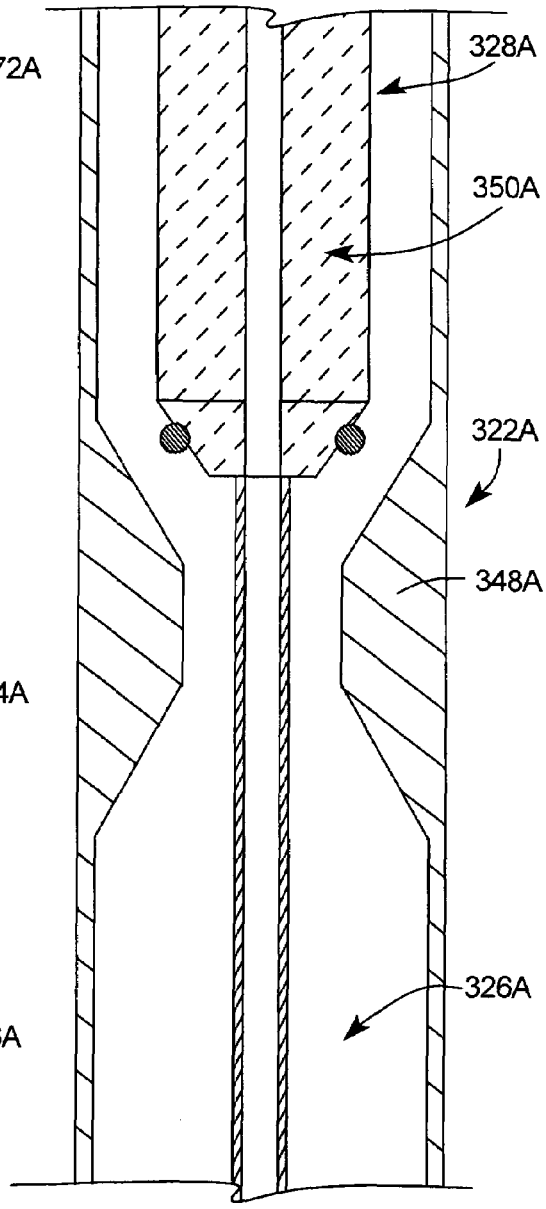
FIG. 3B is a cross-sectional view of the portion of the zone isolation assembly illustrated in FIG. 3A, shown in a disengaged position.

FIG. 3B is a cross-sectional view of the zone isolation assembly 322A illustrated in FIG. 3A, including the docking apparatus 350A shown in the disengaged position relative to the docking receiver 348A. In the disengaged position, any fluid that migrates into the first zone 326A through the fluid inlet structure 229 (illustrated in FIG. 2) can freely move into and mix with the second zone 328A to at least partially fill the riser pipe 230 (illustrated in FIG. 2). In other words, in the disengaged position, the first zone 326A and the second zone 328A are in fluid communication with one another.

Figures 3C, 3D:
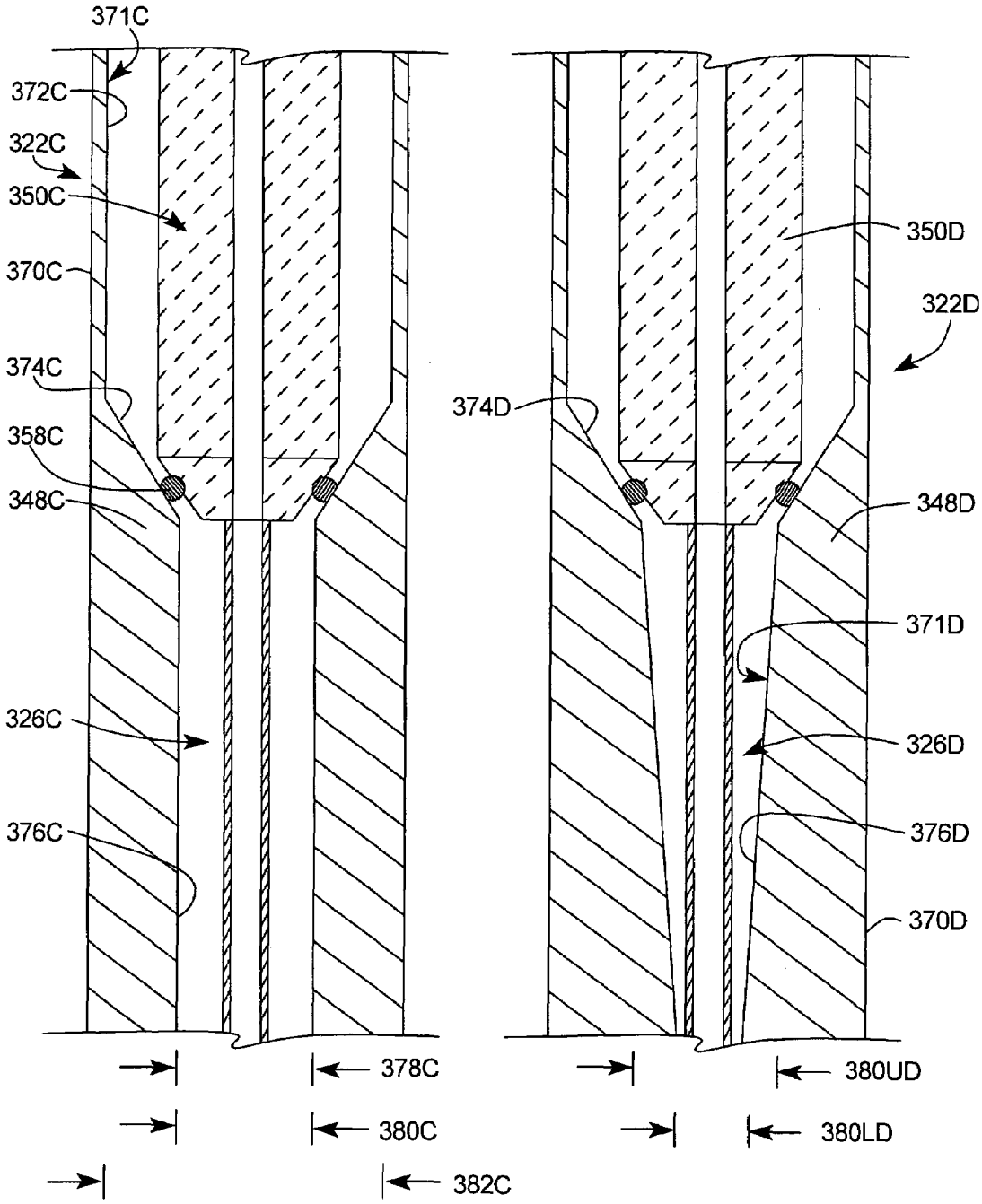
FIG. 3C is a cross-sectional view of a portion of an embodiment of the zone isolation assembly including a docking apparatus shown in an engaged position with a second embodiment of the docking receiver.
FIG. 3D is a cross-sectional view of a portion of an embodiment of the zone isolation assembly including a docking apparatus shown in an engaged position with a third embodiment of the docking receiver.

FIG. 3C is a cross-sectional view of a portion of another embodiment of the zone isolation assembly 322C including a docking apparatus 350C shown in the engaged position with a second embodiment of the docking receiver 348C. In this embodiment, the docking receiver 348C has an exterior surface 370C and an interior surface 371C having a substantially linear upper section 372C, a tapered intermediate section 374C and a substantially linear lower section 376C. In one embodiment, the upper section 372C of the interior surface 371C is substantially parallel with the exterior surface 370C.

The intermediate section 374C has an inner diameter 378C near the location of contact between the resilient seal 358C and the docking receiver 348C that is smaller than an inner diameter 382C of the upper section 372C. Further, the inner diameter 380C of the lower section 376C is somewhat reduced, and is substantially similar to the inner diameter 378C of the intermediate section 376C near the location of contact between the resilient seal 358C and the docking receiver 348C. In this embodiment, the lower section 376C of the interior surface 371C is substantially parallel with the exterior surface 370C. The reduced inner diameter 380C of the lower section 376C provides a smaller volume in the first zone 326C. Because the first zone 326C has a somewhat smaller volume, the volume of the first fluid to be purged from the first zone 326C is reduced, thereby decreasing the purge time prior to sampling the first zone 326C.

FIG. 3D is a cross-sectional view of a portion of another embodiment of the zone isolation assembly 322D including a docking apparatus 350D shown in the engaged position with a third embodiment of the docking receiver 348D. In this embodiment, the lower section 376D has an upper inner diameter 380UD that is greater than a lower inner diameter 380LD of the lower section 376D. Thus, the lower section 376D is tapered so that the inner diameter decreases in a direction from the intermediate section 374D toward the lower section 376D. The In other words, the interior surface 371D of the lower section 376D is non-parallel with the exterior surface 370D. With this design, the volume of the first zone 326D is further reduced. As a result of the reduced volume of the first zone 326D, the volume of groundwater to be purged from the first zone 326D is reduced even more, thereby decreasing the purge time prior to sampling the first zone 326D.

Figure 4:
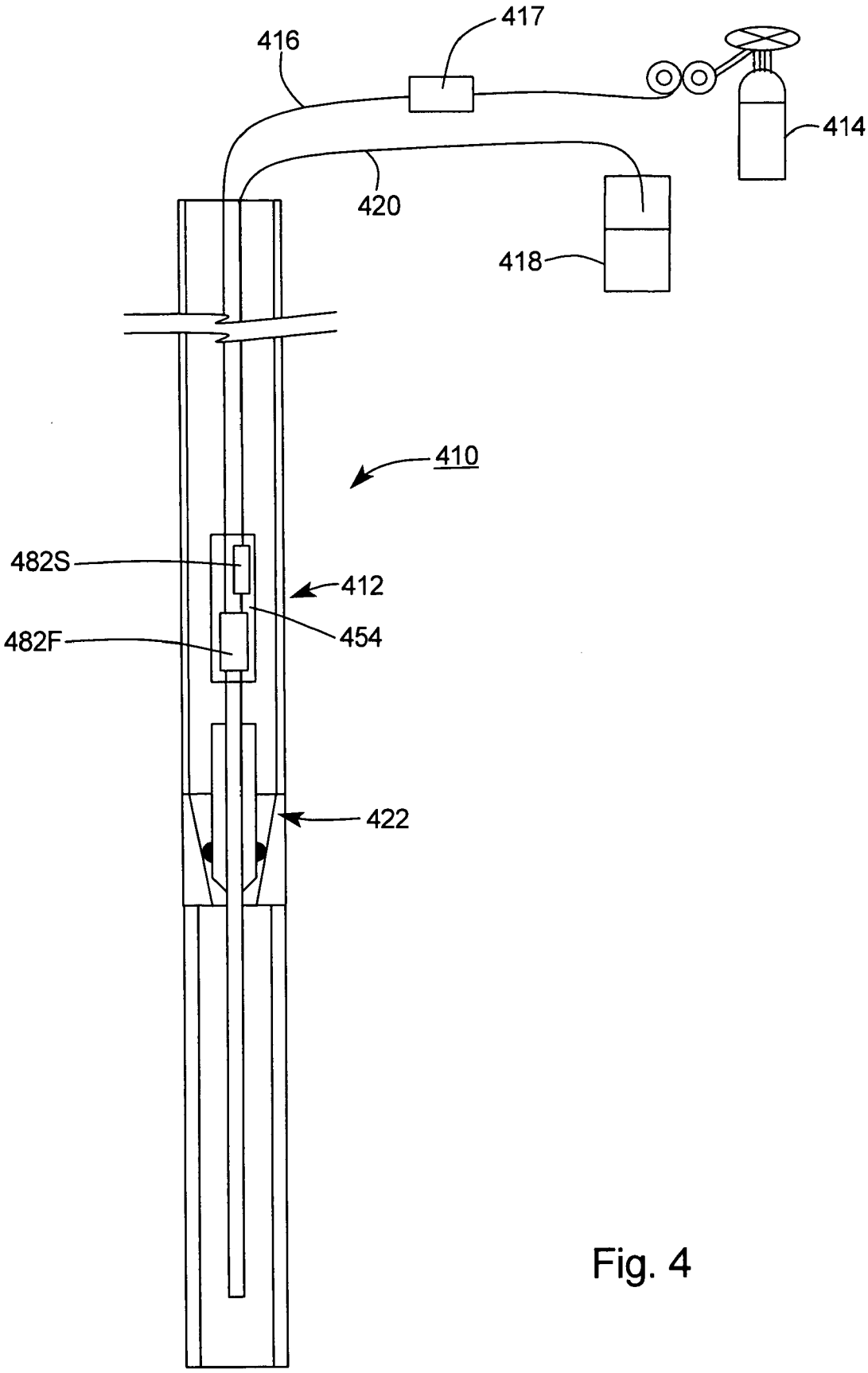
FIG. 4 is a schematic view of another embodiment of the fluid monitoring system.

FIG. 4 is a schematic view of another embodiment of the fluid monitoring system 410. In FIG. 4, the environment 11 (illustrated in FIG. 1) and the annular materials 24A-C (illustrated in FIG. 1) have been omitted for simplicity. In the embodiment illustrated in FIG. 4, the fluid monitoring system 410 includes components and structures that are somewhat similar to those previously described, including the subsurface well 412, the gas source 414, the gas inlet line 416, the controller 417, the fluid receiver 418, the fluid outlet line 420 and the zone isolation assembly 422. However, in this embodiment, the pump assembly 454, described in greater detail below, of the zone isolation assembly 422 includes two one-way valves including a first valve 482F and a second valve 482S. The pump assembly 454 provides one or more advantages over other types of pump assemblies as set forth herein.

Figure 5:
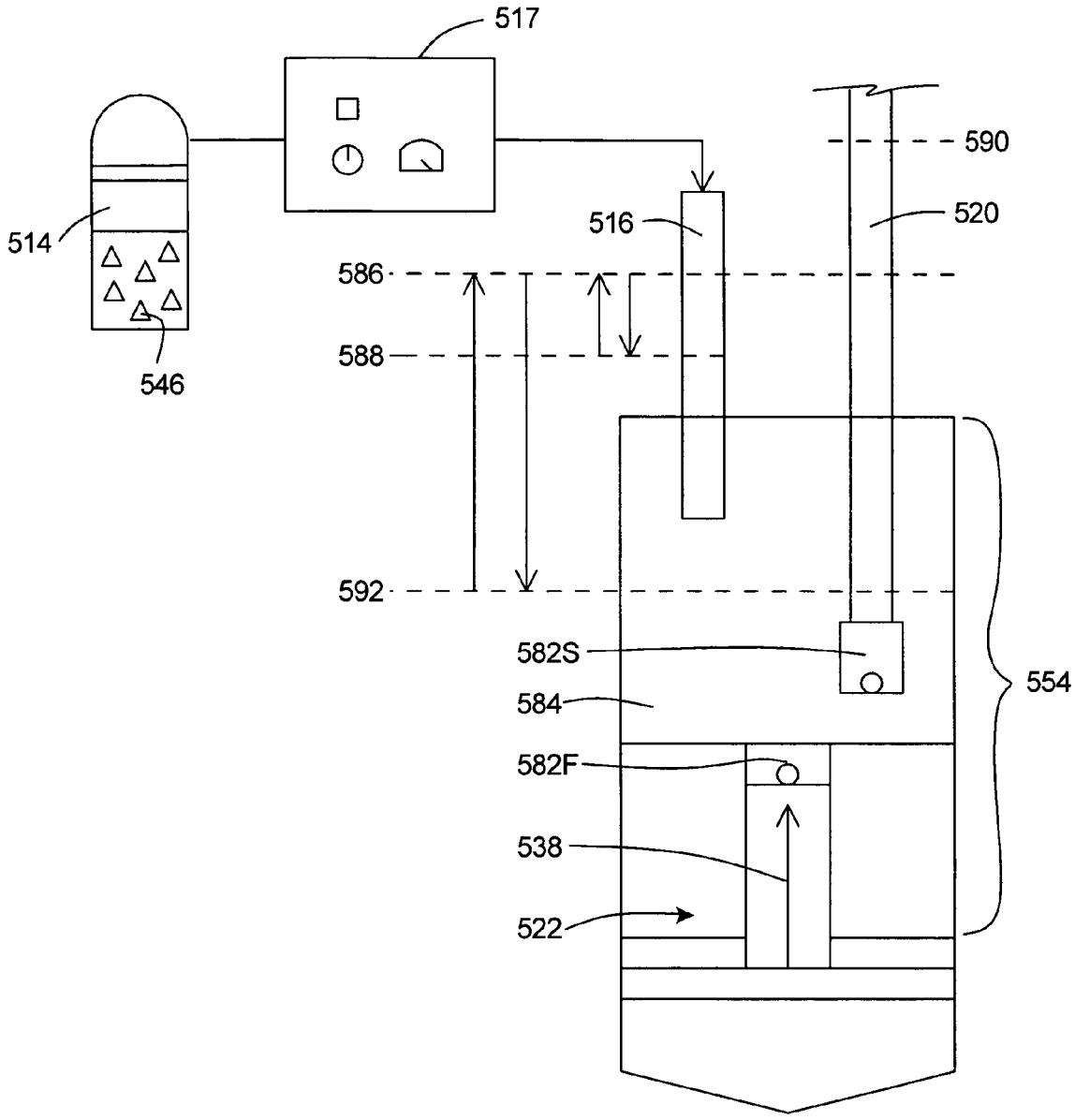
FIG. 5 is a schematic view of a portion of one embodiment of the fluid monitoring system including a pump assembly.

FIG. 5 is a schematic diagram of a portion of one embodiment of the fluid monitoring system 510 including a gas source 514, a gas inlet line 516, a controller 517, a fluid outlet line 520, a zone isolation assembly 522, and a pump assembly 554. The zone isolation assembly 522 functions in a substantially similar manner as previously described. More specifically, the first zone 26 (illustrated in FIG. 1) is isolated from the second zone 28 (illustrated in FIG. 1) so that the first fluid 538 can migrate or be drawn into the pump assembly 554.

The specific design of the pump assembly 554 can vary. In this embodiment, the pump assembly 554 is a two-valve, two-line assembly. The pump assembly 554 includes a pump chamber 584, a first valve 582F, a second valve 582S, a portion of the gas inlet line 516 and a portion of the fluid outlet line 520. The pump chamber 584 can encircle one or more of the valves 582F, 582S and/or portions of the lines 516, 520.

The first valve 582F is a one-way valve that allows the first fluid (represented by arrow 538) to migrate or otherwise be transported from the first zone 26 into the pump housing 584. For example, the first valve 582F can be a check valve or any other suitable type of one-way valve that is open as the well fluid level 42W (illustrated in FIG. 1) equilibrates with the environmental fluid level 42E (illustrated in FIG. 1). As the level of the first fluid 538 rises, the first valve 582F is open, allowing the first fluid 538 to pass through the first valve 582F and into the pump chamber 584. However, if the level of the first fluid 538 begins to recede, the first valve 582F closes and inhibits the first fluid 538 from moving back into the first zone 26.

The second valve 582S can also be a one-way valve that operates by opening to allow the first fluid 538 into the fluid outlet line 520 as the level of the first fluid 538 rises within the pump chamber 584 due to the equilibration process described previously. However, any back pressure in the fluid outlet line 520 causes the second valve 582S to close, thereby inhibiting the first fluid 538 from receding from the fluid outlet line 520 back into the pump chamber 584.

In certain embodiments, the first fluid 538 within the fluid outlet line 520 is systematically moved toward and into the fluid receiver 18 (illustrated in FIG. 1). In FIG. 5, two different embodiments for moving the first fluid 538 toward the fluid receiver 18 are illustrated. In the first embodiment, the first fluid 538 is allowed to equilibrate to an initial fluid level 586 in both the gas inlet line 516 and the fluid outlet line 520. The controller 517 (or an operator) then causes the gas 546 from the gas source 514 to move downward in the gas inlet line 516 to force the first fluid 538 to a second fluid level 588 in the gas inlet line 516. This force causes the first valve 582F to close, and because the first fluid 538 has nowhere else to move to, the first fluid 538 forces the second valve 582S to open to allow the first fluid 538 to move in an upwardly direction in the fluid outlet line 520 to a third fluid level 590 in the fluid outlet line 520.

The gas source 514 is then turned off to allow the level of the first fluid 538 in the gas inlet line 516 to equilibrate with the environmental fluid level 42E. The second valve 582S closes, inhibiting any change in the level of the first fluid 538 in the fluid outlet line 520. Once the first fluid 538 in the gas inlet line 516 has equilibrated with the environmental fluid level 42E, the process of opening the gas source 514 to move the gas 546 downward in the gas inlet line 516 is repeated. Each such cycle raises the level of the first fluid 538 in the fluid outlet line 520 until a desired amount of the first fluid 538 reaches the fluid receiver 18. The gas cycling in this embodiment can be utilized regardless of the time required for the first fluid 538 to equilibrate, but this embodiment is particularly suited toward a relatively slow equilibration processes.

In the second embodiment illustrated in FIG. 5, a greater volume of gas 546 is used following equilibration of the first fluid to the initial fluid level 586. Thus, in this embodiment, instead of maintaining the gas 546 within the gas inlet line 516 during each cycle, the gas source 514 is opened until the first fluid 538 is forced downward, out of the gas inlet line 516 and downward in the pump chamber 584 to a fourth fluid level 592 within the pump chamber 584. As provided previously, when the gas 546 is forced downward into the pump chamber 584, the first valve 582F closes and the second valve 582S opens. This allows the first fluid 538 to move upward in the fluid outlet line 520 to a greater extent during each cycle. The gas source 514 is then closed, the first fluid within the pump chamber 584 and the gas inlet line 516 equilibrates, and the cycle is repeated until the desired volume of first fluid 538 is delivered to the fluid receiver 18. The cycling in this embodiment can be utilized regardless of the time required for the first fluid 538 to equilibrate, but this embodiment is particularly suited toward a relatively rapid equilibration process.

With these designs, because the gas 546 is cycled up and down within the gas inlet line 516 and or pump chamber 584, and no pressurization of the riser pipe 30 (illustrated in FIG. 1) is required, only a small volume of gas 546 is consumed, and the gas 546 is thereby conserved. Further, in this embodiment, the gas 546 does not come into contact with the first fluid 538 in the fluid outlet line 520. Consequently, potential VOC loss caused by contact between the gas 546 and the first fluid 538 can be inhibited or eliminated.

Figure 6:
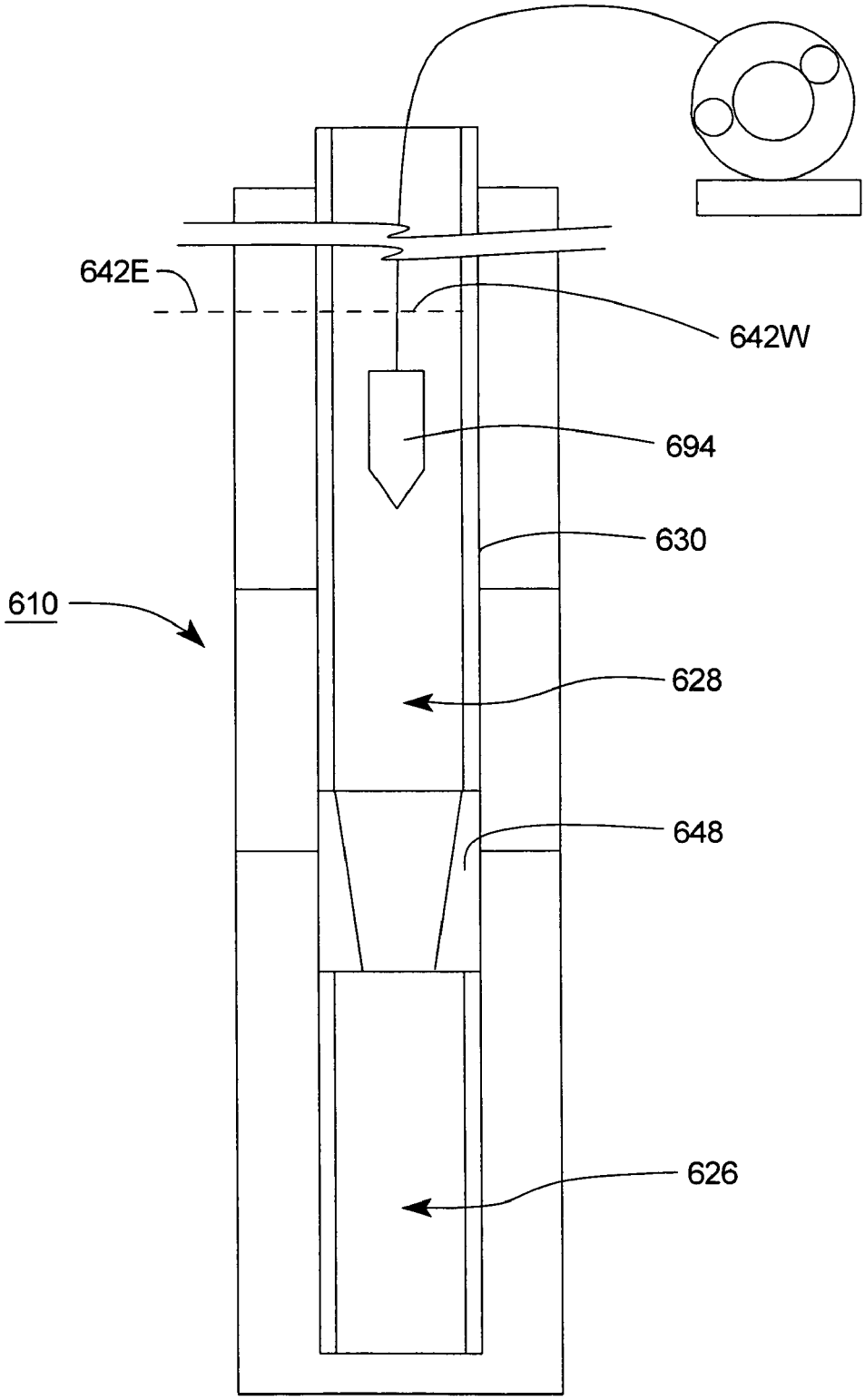
FIG. 6 is a schematic view of a portion of another embodiment of the fluid monitoring system.

FIG. 6 is a schematic view of a portion of another embodiment of the fluid monitoring system 610. In this embodiment, the docking apparatus 50 (illustrated in FIG. 1, for example) described in previous embodiments has been removed and replaced with a portable fluid level sensor 694, while the docking receiver 648 can be left in place. Thus, in this embodiment, determining the well fluid level 642W within the riser pipe 630 can easily be achieved because without the docking apparatus 50 in the engaged position, the first zone 626 and the second zone 628 are in fluid communication with one another, allowing the well fluid level 642W to equilibrate with the environmental fluid level 642E.

In an alternative embodiment, the docking apparatus 50 need not be completely removed from the riser pipe 630 to determine the well fluid level 642W. Rather, the docking apparatus 50 need only be moved upward to the disengaged position to permit the first zone 626 and the second zone 628 to be in fluid communication with one another, at which time the well fluid level 642W can be determined with the portable fluid level sensor 694.

Figure 7A:
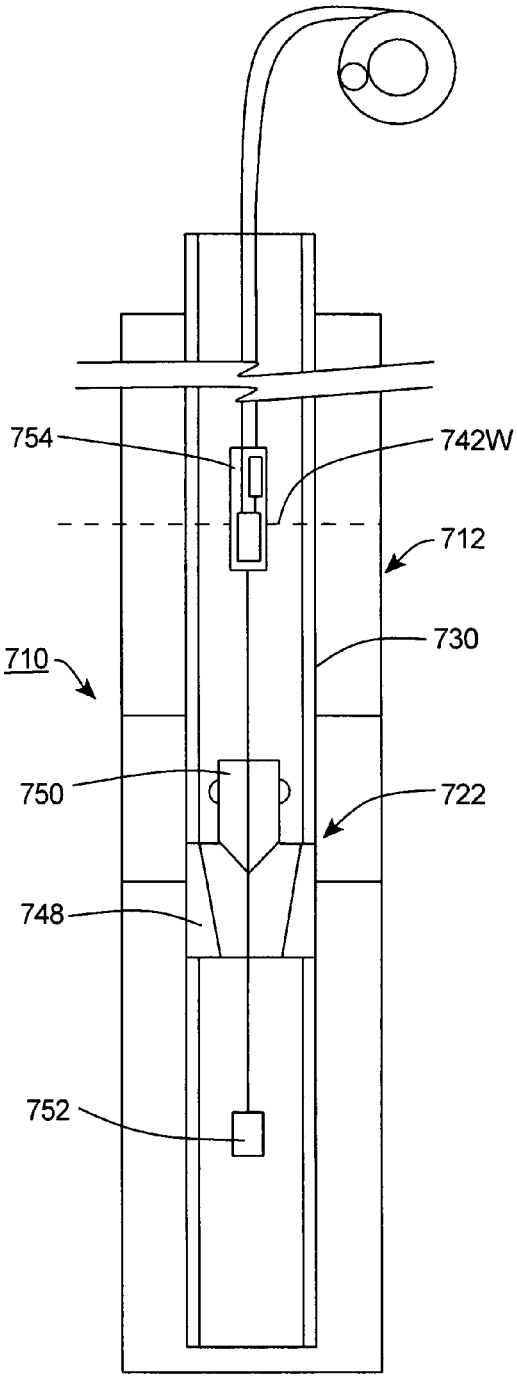
FIG. 7A is a schematic view of a portion of yet another embodiment of the fluid monitoring system including a zone isolation assembly with the docking apparatus illustrated in a disengaged position.
Figure 7B:
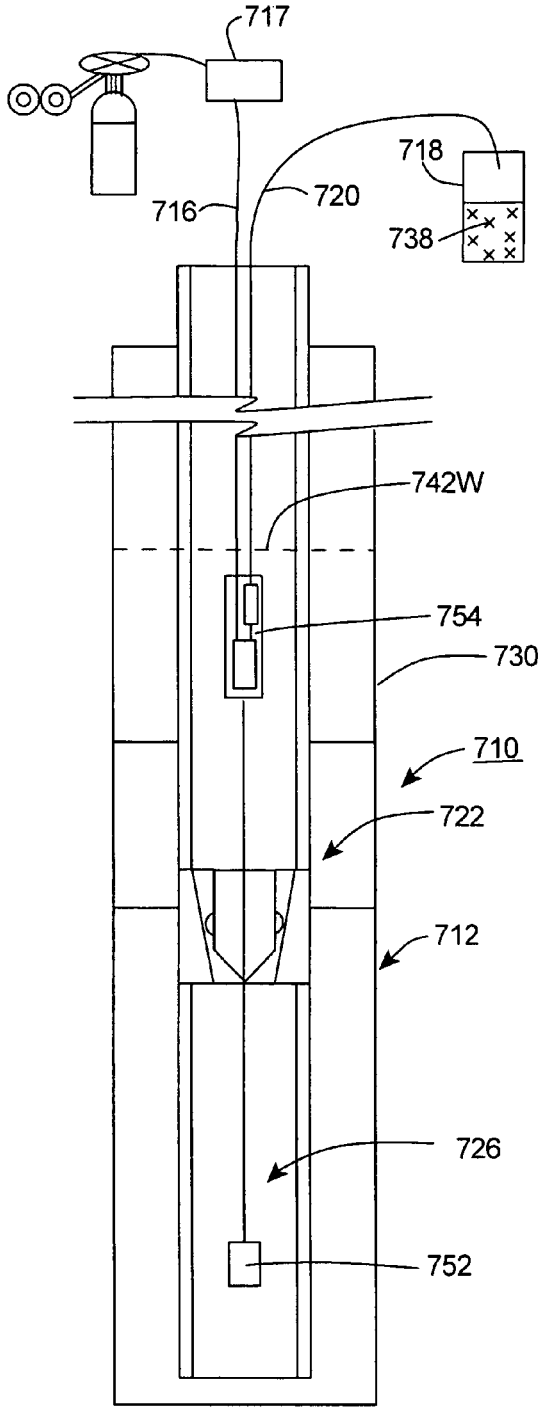
FIG. 7B is a schematic view of a portion of the fluid monitoring system illustrated in FIG. 7A, including the zone isolation assembly with the docking apparatus illustrated in an engaged position.

FIGS. 7A and 7B are schematic views of a portion of another embodiment of the fluid monitoring system 710, illustrated in the disengaged position and the engaged position, respectively. In this embodiment, the fluid monitoring system 710 includes the zone isolation assembly 722 having certain components that are somewhat similar to those previously described, such as the docking receiver 748, the docking apparatus 750, the fluid collector 752 and the pump assembly 754. The docking apparatus 750, the fluid collector 752 and the pump assembly 754 are lowered into the riser pipe 730 as illustrated in FIG. 7A.

However, in this embodiment, when the docking apparatus 750 is in the engaged position (FIG. 7B), the pump assembly 754 is positioned just below the well fluid level 742W in the riser pipe 730. The well fluid level 742W can be determined by using the fluid level sensor 694 (illustrated in FIG. 6) or any other suitable method. In this embodiment, the length of the gas inlet line 716 and the fluid outlet line 720 can be decreased from embodiments that have the pump assembly 754 positioned nearer the docking apparatus 750, e.g. at a greater depth in the well 712. As a result, the overall cost of the zone isolation assembly 722 is reduced. Thus, the pump assembly 754 serves more or less as a lift station for moving fluid to the surface region 32 (illustrated in FIG. 1). A single hydrostatic fill line is all that is required from the bottom of the pump assembly 754 to the fluid intake point. Each time the pump cycles to the off position, more fluid hydrostatically rises within the pump chamber 784 of the pump assembly 754. When the controller 717 cycles back to the on position, the new fluid within the pump chamber 784 is pushed toward the surface region 32.

In this embodiment, the fluid collector 752 can be a screened or filtered intake positioned within the first zone 726 when the docking apparatus 750 is in the engaged position as illustrated in FIG. 7B. The pump cycles as previously described can be utilized with this embodiment to move the first fluid 738 to the fluid receiver 718.

Figure 8A:
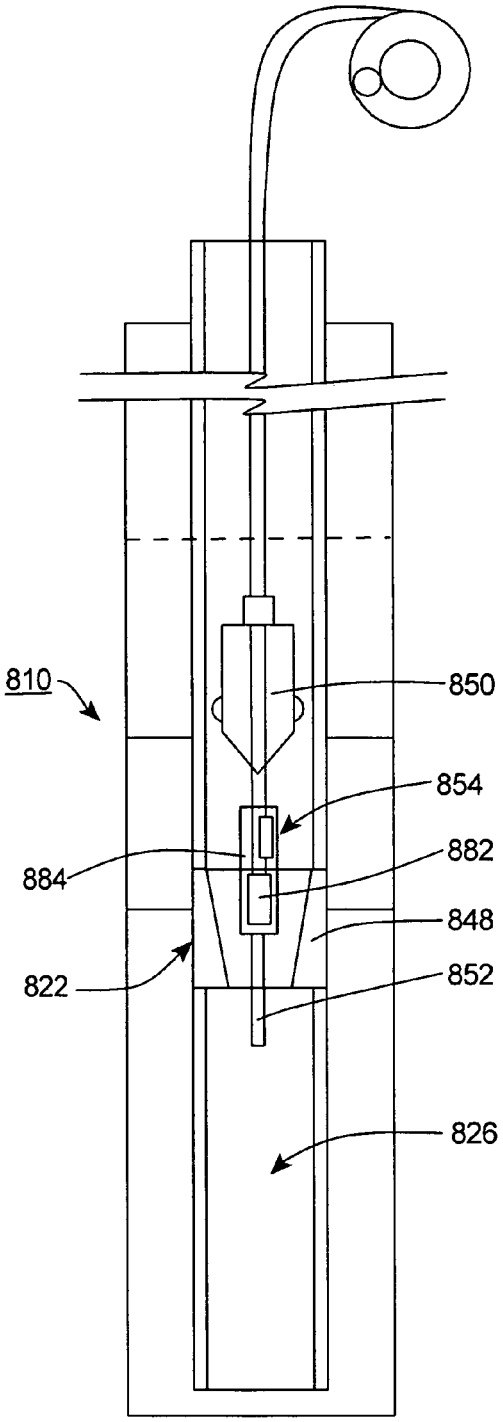
FIG. 8A is a schematic view of a portion of still another embodiment of the fluid monitoring system including the zone isolation assembly with the docking apparatus illustrated in a disengaged position.
Figure 8B:
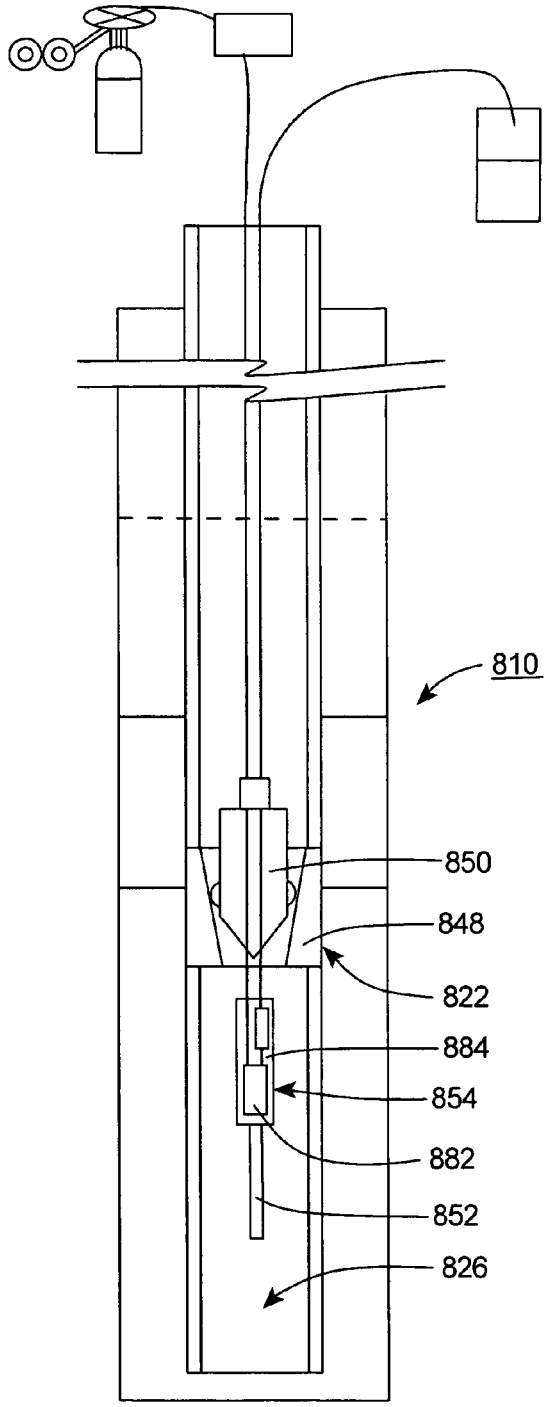
FIG. 8B is a schematic view of a portion of the fluid monitoring system illustrated in FIG. 8A, including the zone isolation assembly with the docking apparatus illustrated in an engaged position.

FIGS. 8A and 8B are schematic views of a portion of another embodiment of the fluid monitoring system 810, illustrated in the disengaged position and the engaged position, respectively. In this embodiment, the fluid monitoring system 810 includes the zone isolation assembly 822 having certain components that are somewhat similar to those previously described, such as the docking receiver 848, the docking apparatus 850, the fluid collector 852 and the pump assembly 854. The docking apparatus 850, the fluid collector 852 and the pump assembly 854 are lowered into the riser pipe 830 as illustrated in FIG. 8A.

However, in this embodiment, the pump assembly 854 is positioned beneath the docking apparatus 850 so that when the docking apparatus 850 is in the engaged position, the pump assembly 854 is positioned within the first zone 826. In other words, the pump assembly 854 is sized and shaped to fit through the docking receiver 848 when the docking apparatus 850 is moved between the engaged and the disengaged positions.

In certain embodiments, the fluid collector 852 can be a fluid filter positioned at the entrance of the pump chamber 884, near one of the valves of the pump assembly 854. The fluid filter can inhibit any sediment or other unwanted material from entering the pump chamber 884.

Further, in certain embodiments that utilize the pump assembly 854 positioned within the first zone 826 when the docking apparatus 850 is in the engaged position, the fluid collector 852 may or may not be present. In such embodiments that do not utilize the fluid collector 852, the pump assembly 854 can include a one-way valve 882 that allows the first fluid 838 to enter the pump chamber 884 directly. In these embodiments, the pump assembly 854 can include one or more one-way valves 882, as previously described herein.

Figure 9A:
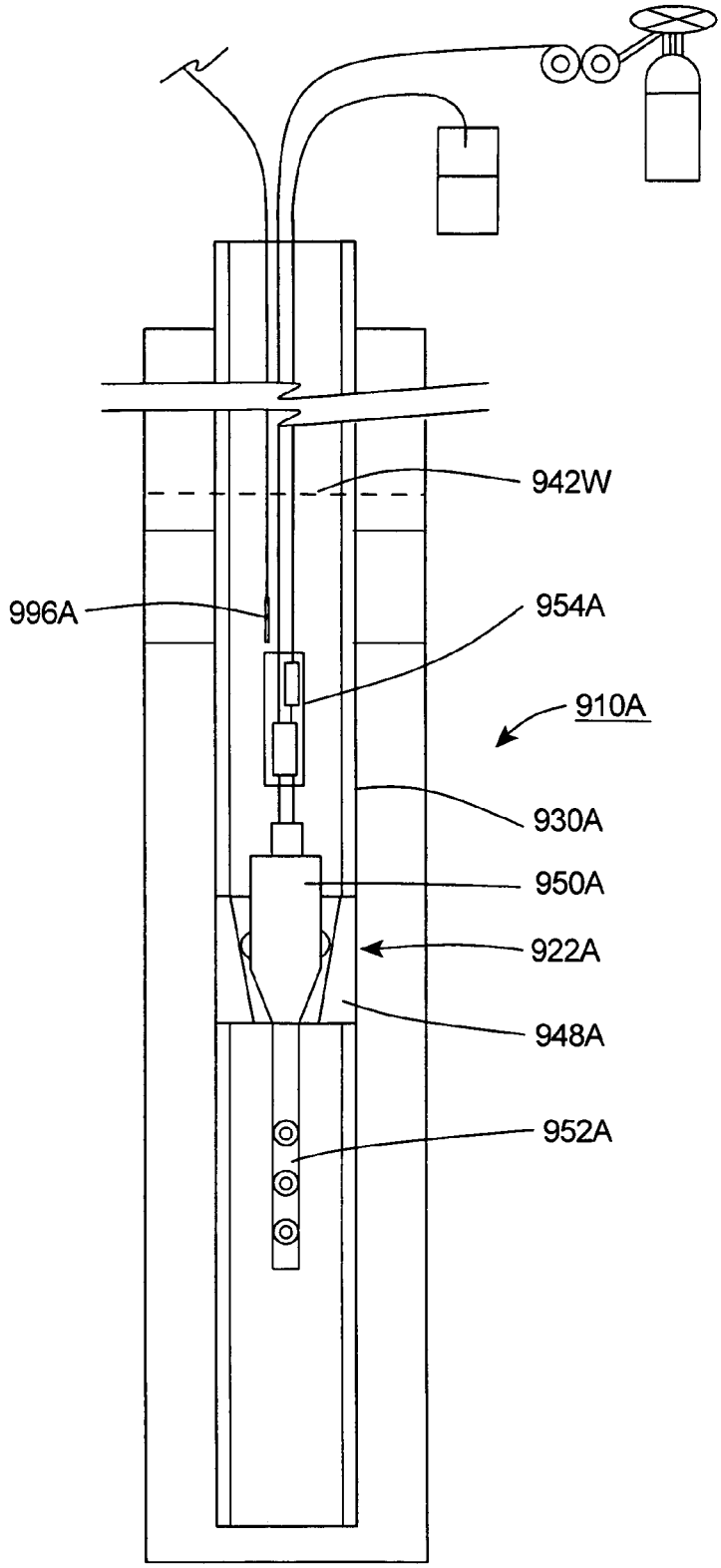
FIG. 9A is a schematic view of a portion of one embodiment of the fluid monitoring system.

FIG. 9A is a schematic view of a portion of another embodiment of the fluid monitoring system 910A, including the zone isolation assembly 922A. In this embodiment, the zone isolation assembly 922A includes the docking receiver 948A, the docking apparatus 950A, the fluid collector 952A, the pump assembly 954A and a pressure sensor 996A. The components of the zone isolation assembly 922A can be configured and can operate as described herein. The pressure sensor 996A can be used to monitor the well fluid level 942W in the riser pipe 930A at various times. In one embodiment, the pressure sensor 996A is a transducer that can sense the pressure and send a signal to the controller 17 (illustrated in FIG. 1), which can in turn determine the well fluid level 942W. The type of transducer can vary. In non-exclusive embodiments, the transducer can be fiber-optic, electrical, or any other suitable type of transducer. With this design, it is unnecessary to completely remove the docking apparatus 950A from the riser pipe 930A to determine the well fluid level 942W.

The fluid collector 952A can be any type of fluid collector described herein. In the embodiment illustrated in FIG. 9A, the fluid collector 952A is a sipping tube described previously.

Figure 9B:
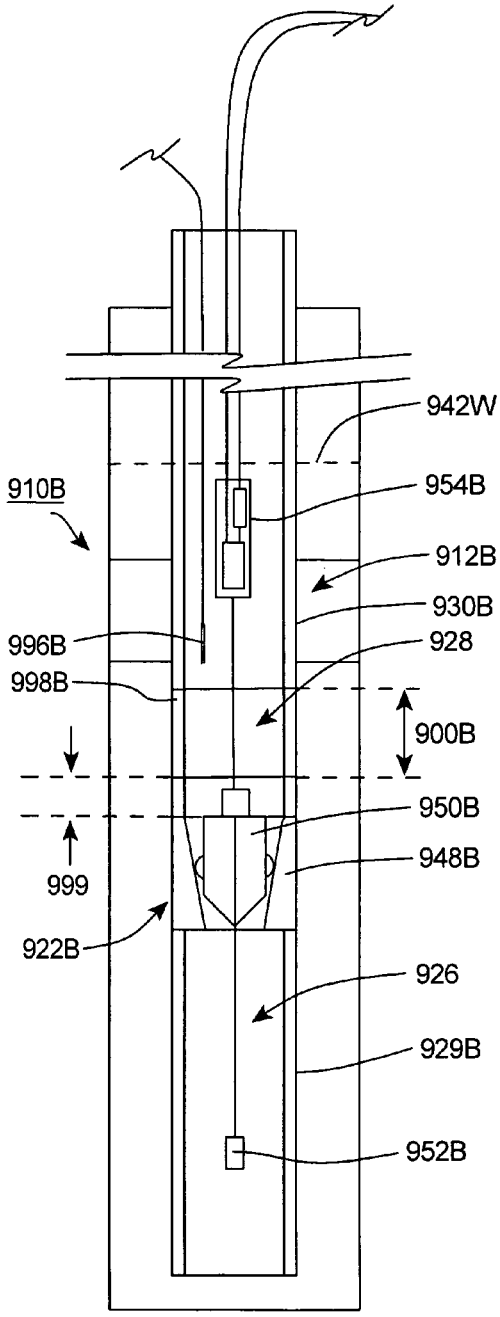
FIG. 9B is a schematic view of a portion of another embodiment of the fluid monitoring system.

FIG. 9B is a schematic view of a portion of another embodiment of the fluid monitoring system 910B, including the zone isolation assembly 922B. In this embodiment, the zone isolation assembly 922B includes the docking receiver 948B, the docking apparatus 950B, the fluid collector 952B, the pump assembly 954B and the pressure sensor 996B. In this embodiment, the pump assembly 954B is positioned within the second zone 928 while the docking apparatus 950B is in the engaged position.

Additionally, in this embodiment, the well 912B includes a second fluid inlet structure 998B that is positioned above the docking receiver 948B, adjacent to the second zone 928. The second fluid inlet structure 998B can have a height 900B that varies depending upon the design requirements of the fluid monitoring system 910B. In one embodiment, the second fluid inlet structure 998B is used in conjunction with monitoring the well fluid level 942W, and can therefore have a height 900B that is less than approximately five feet. Alternatively, the second fluid inlet structure 998B can have a height 900B that is greater than five feet.

The second fluid inlet structure 998B can be secured to the riser pipe 930B and/or the docking receiver 948B. In one embodiment, the second fluid inlet structure 998B is not positioned immediately adjacent to the docking receiver 948B, but is positioned at a level that is somewhat above the docking receiver 948B so that there is a spacing 999 between the docking receiver 948B and the second fluid inlet structure 998B. The spacing 999 can be present to account for the presence of the docking apparatus 950B when in the engaged position, so that fluid flow into the riser pipe 930B through the second fluid inlet structure 998B is not substantially impeded.

The pressure sensor 996B can periodically or continuously monitor the well fluid level 942W, which can change independent of any sampling that may occur from the fluid inlet structure 929B below the docking receiver 948B. The second fluid inlet structure 998B and the pressure sensor 996B can also be used at various times for various purposes, such as for pump tests and/or slug tests for measuring permeability of the environment 11 (illustrated in FIG. 1), and for monitoring draw-down effects during purging of the first fluid 38 (illustrated in FIG. 1) fluid from the first zone 926, as non-exclusive examples.

The fluid collector 952B can be any type of fluid collector described herein. In the embodiment illustrated in FIG. 9B, the fluid collector 952B is a screened or filtered intake as described previously.

Figure 9C:
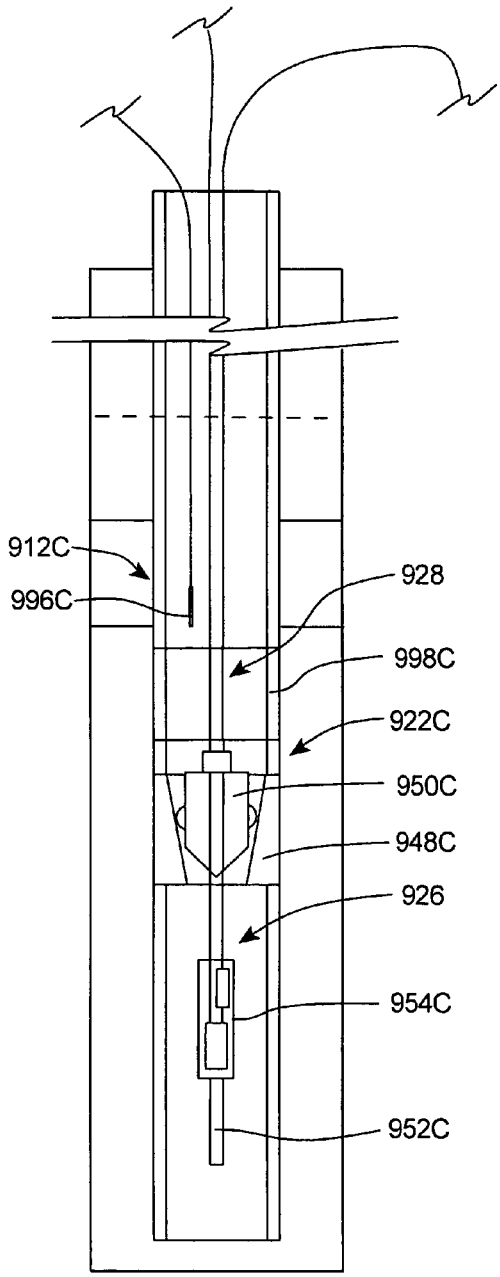
FIG. 9C is a schematic view of a portion of yet another embodiment of the fluid monitoring system.

FIG. 9C is a schematic view of a portion of another embodiment of the fluid monitoring system 910C, including the zone isolation assembly 922C. In this embodiment, the zone isolation assembly 922C includes the docking receiver 948C, the docking apparatus 950C, the fluid collector 952C, the pump assembly 954C and the pressure sensor 996C. In this embodiment, the pump assembly 954C is positioned in the first zone 926 while the docking apparatus 950C is in the engaged position. Further, the fluid collector 952C can be a fluid filter positioned at the entrance of the pump chamber 984C, near one of the valves of the pump assembly 954C as described previously herein. Additionally, in this embodiment, the well 912C includes the second fluid inlet structure 998C that is positioned above the docking receiver 948C, adjacent to the second zone 928.

Figure 10A:
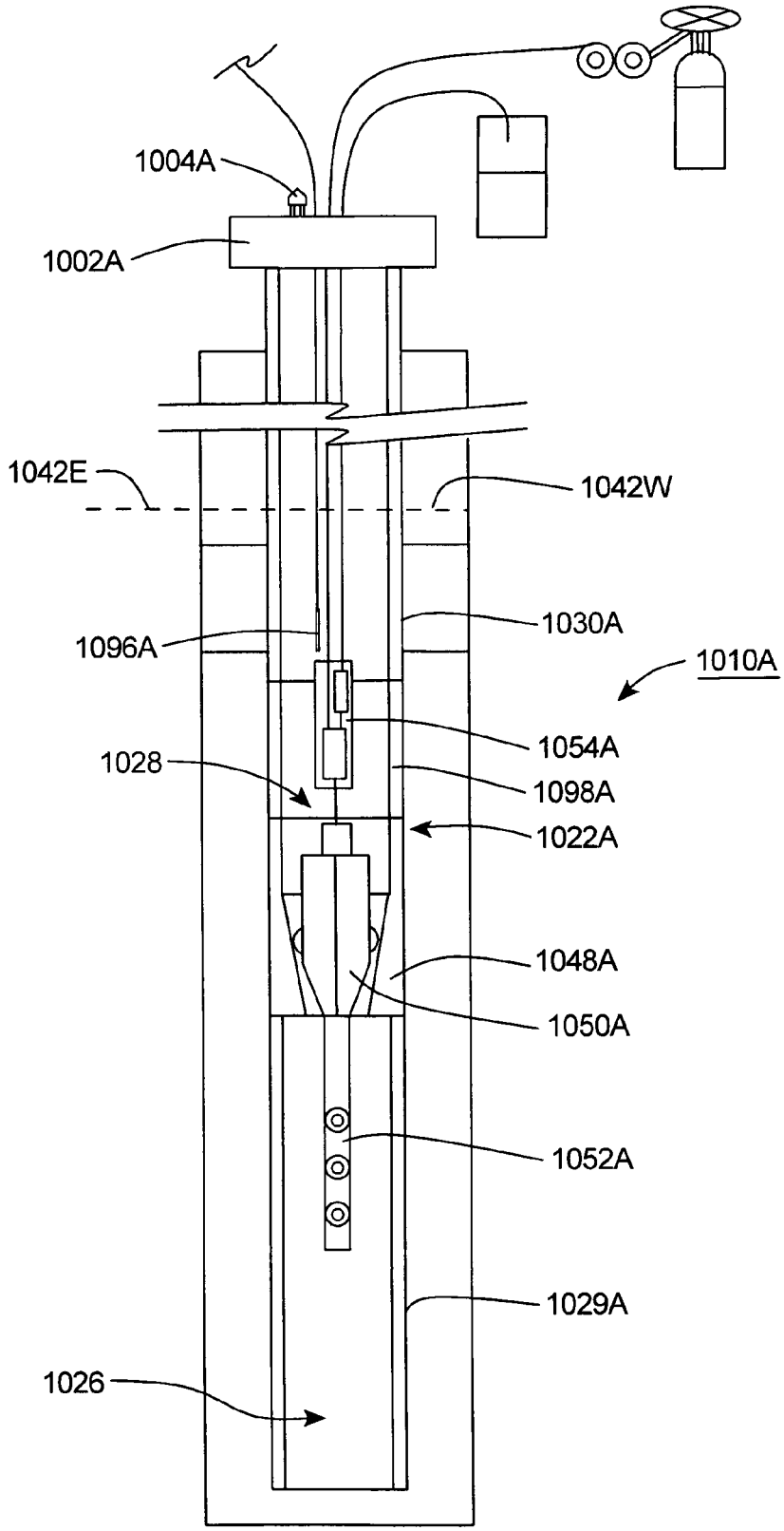
FIG. 10A is a schematic view of a portion of still another embodiment of the fluid monitoring system.

FIG. 10A is a schematic view of a portion of another embodiment of the fluid monitoring system 1010A, including the zone isolation assembly 1022A. In this embodiment, the zone isolation assembly 1022A includes the docking receiver 1048A, the docking apparatus 1050A, the fluid collector 1052A, the pump assembly 1054A and the pressure sensor 1096A. In this embodiment, the pump assembly 1054A is positioned within the second zone 1028 while the docking apparatus 1050A is in the engaged position.

Additionally, in this embodiment, the zone isolation assembly 1022A includes a manifold 1002A that can be positioned at or near a top end of the riser pipe 1030A, which can be at or above the surface region 32 (illustrated in FIG. 1). The manifold 1002A can include any type of cap, cover or other closure that can effectively form a fluid-tight seal at or near the top of the riser pipe 1030A. In certain embodiments, such as that shown in FIG. 10A, the manifold 1002A includes a vent 1004A.

The vent 1004A can be in an open position to allow air or other fluid into the riser pipe 1030A, or in a closed position to inhibit air or fluid from entering the riser pipe 1030A following closure of the vent 1004A. In the open position, draw-down of the second fluid 40 (illustrated in FIG. 1) from the second zone 1028 through the second fluid inlet structure 1098A can occur. However, in the closed position, draw-down of the second fluid 40 from the second zone 1028 through the second fluid inlet structure 1098A is inhibited or minimized. For example, during sampling of the first fluid 38 (illustrated in FIG. 1) from the first zone 1026, the second fluid 40 might otherwise be susceptible to draw-down without the presence of the manifold 1002A. With this design, the flow of fluid from the second zone 1028 out through the second fluid inlet structure 1098A, into the fluid inlet structure 1029A, and into the first zone 1026 is inhibited.

When sampling of the first fluid 38 from the first zone 1026 is completed, the vent 1004A is moved to the open position, and the well fluid level 1042W can be allowed to equilibrate with the environmental fluid level 1042E.

It is recognized that the manifold 1002A described herein can be utilized with any other suitable embodiment to achieve the desired effect of the manifold 1002A provided herein.

Figure 10B:
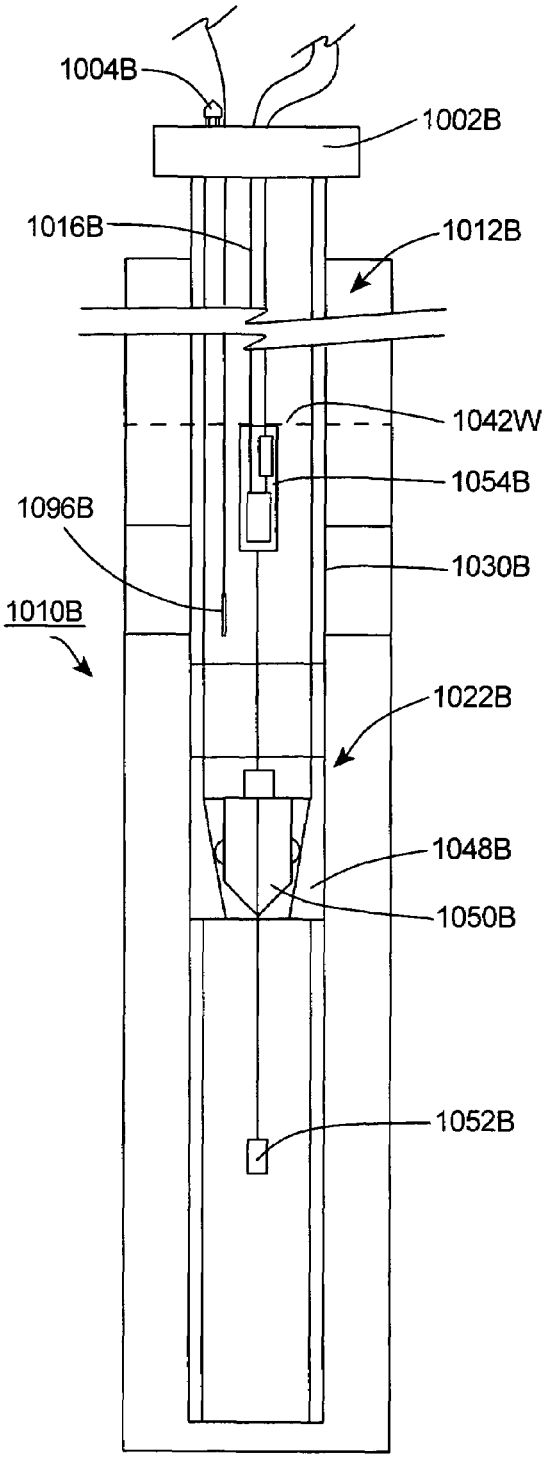
FIG. 10B is a schematic view of a portion of another embodiment of the fluid monitoring system.

FIG. 10B is a schematic view of a portion of another embodiment of the fluid monitoring system 1010B, including the zone isolation assembly 1022B. In this embodiment, the zone isolation assembly 1022B includes the docking receiver 1048A, the docking apparatus 1050B, the fluid collector 1052B, the pump assembly 1054B and the pressure sensor 1096B. In this embodiment, when the docking apparatus 1050B is in the engaged position, the pump assembly 1054B is positioned just below the well fluid level 1042W in the riser pipe 1030B. In this embodiment, the length of the gas inlet line 1016B and the fluid outlet line 1020B can be decreased from embodiments that have the pump assembly positioned nearer the docking apparatus 1050B, e.g. at a greater depth in the well 1012B. As a result, the overall cost of the zone isolation assembly 1022B can be reduced.

Further, in this embodiment, the zone isolation assembly 1022B includes the manifold 1002B having a vent 1004B similar to that illustrated in FIG. 10A. The fluid collector 1052B can be any type of fluid collector described herein. In the embodiment illustrated in FIG. 10B, the fluid collector 1052B is a screened or filtered intake as described previously.

Figure 10C:
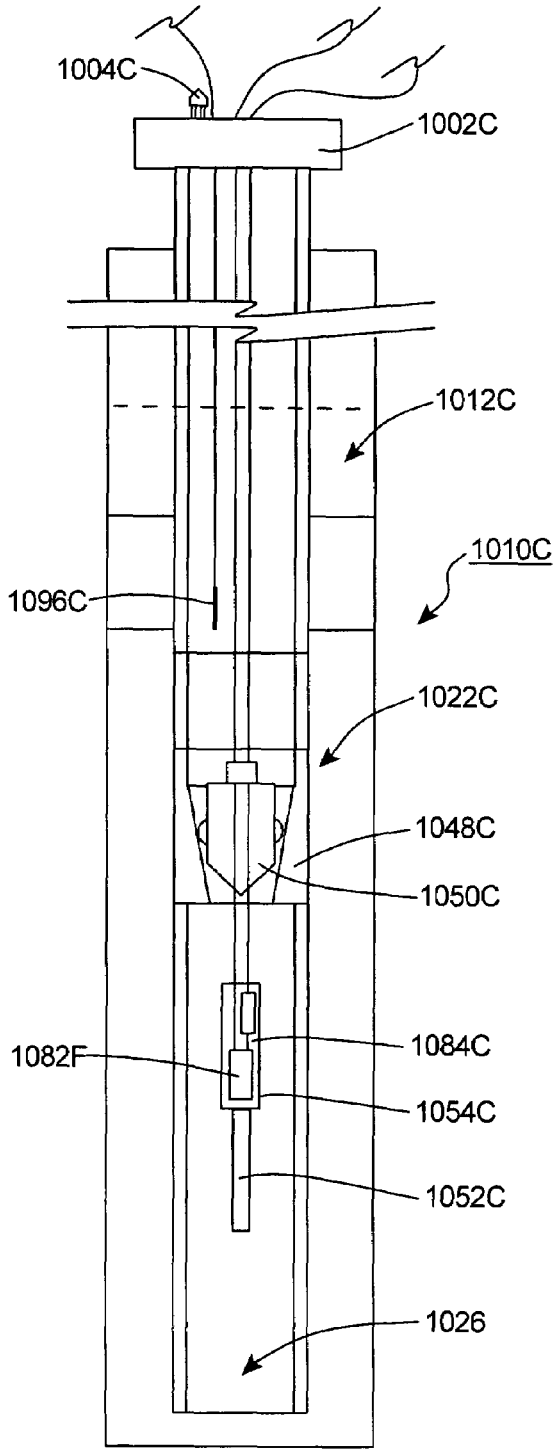
FIG. 10C is a schematic view of a portion of yet another embodiment of the fluid monitoring system.

FIG. 10C is a schematic view of a portion of another embodiment of the fluid monitoring system 1010C, including the zone isolation assembly 1022C. In this embodiment, the zone isolation assembly 1022C includes the docking receiver 1048C, the docking apparatus 1050C, the fluid collector 1052C, the pump assembly 1054C and the pressure sensor 1096C. In this embodiment, the zone isolation assembly 1022C includes the manifold 1002C having a vent 1004C similar to that illustrated in FIG. 10A. Further, in this embodiment, the pump assembly 1054C is positioned in the first zone 1026 while the docking apparatus 1050C is in the engaged position. In the embodiment illustrated in FIG. 10C, the fluid collector 1052C can be a fluid filter positioned at the entrance of the pump chamber 1084C, near one of the valves 1082F of the pump assembly 1054C as described previously herein.

Figure 11:
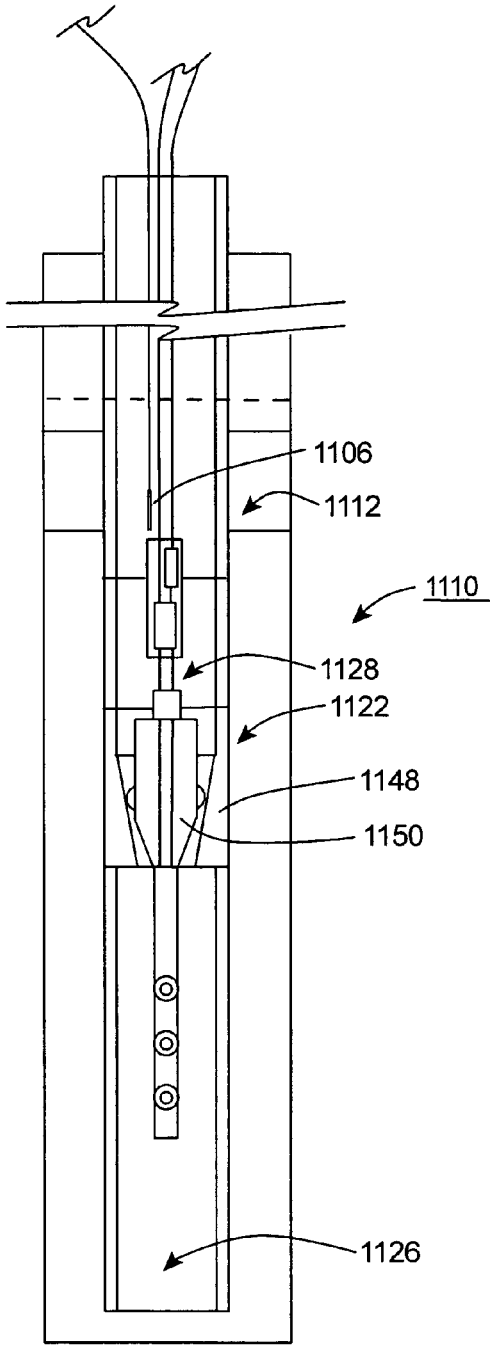
FIG. 11 is a schematic view of a portion of still another embodiment of the fluid monitoring system.

FIG. 11 is a schematic view of a portion of still another embodiment of the fluid monitoring system 1110 including the zone isolation assembly 1122. In this embodiment, the zone isolation assembly 1122 includes one or more fluid property sensors 1106 that can be suspended into the second zone 1128 of the well 1112 without being coupled to the docking receiver 1148 or the docking apparatus 1150. Additionally or alternatively, the fluid property sensor(s) 1106 can be coupled to at least one of the docking receiver 1148 and the docking apparatus 1150, and can be positioned within the first zone 1126 of the well 1112. Each fluid property sensor 1106 can monitor and/or measure one or more fluid properties, which can be communicated to the controller 17 (illustrated in FIG. 1) for analysis. These properties can include, without limitation, pressure, flow, refractive index, specific conductivity, temperature, oxidation reduction potential, pH, and dissolved oxygen, as non-exclusive examples.

Figure 12:
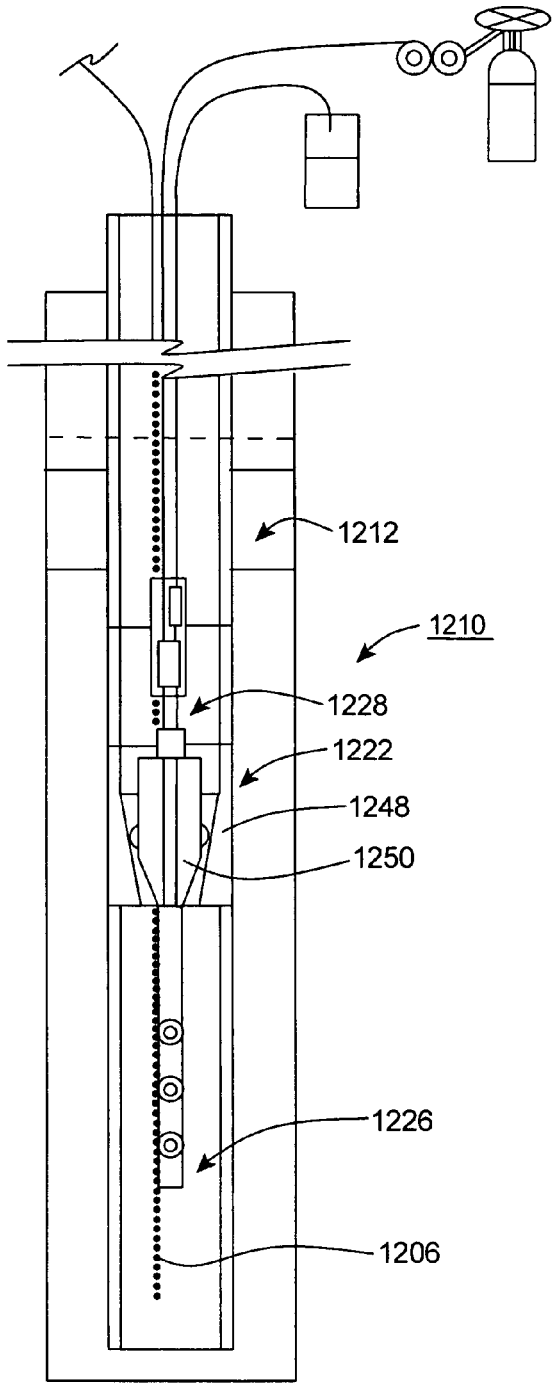
FIG. 12 is a schematic view of a portion of another embodiment of the fluid monitoring system.

FIG. 12 is a schematic view of a portion of yet another embodiment of the fluid monitoring system 1210 including the zone isolation assembly 1222. In this embodiment, the fluid monitoring system 1210 also includes a fluid property sensor 1206 that is positioned within the well 1212. In certain embodiments, the fluid property sensor 1206 can be included as part of the zone isolation assembly 1222, and can be coupled to at least one of the docking receiver 1248 and the docking apparatus 1250. Alternatively, the fluid property sensor 1206 can be separate from the zone isolation assembly 1222 and can be suspended into the second zone 1228 of the well 1212 without being coupled to the docking receiver 1248 or the docking apparatus 1250.

In one embodiment, the fluid property sensor 1206 is a Fiber Bragg Grating (FBG) sensor (illustrated by a dotted line). As used herein, the FBG sensor includes an optical fiber cable with intrinsic sensor elements written into the core of the fiber. As broadband light is directed down the fiber, the grating produces a narrow-band reflection whose wavelength is proportional to the modulation periodicity of the refractive index. The remainder of the light passes through the grating and may be used to interrogate other sensors written at different wavelengths.

With this design, multiple channels of data can be carried along a single fiber substantially simultaneously. The properties of the fluid that can be monitored with the FBG sensor include one or more of physical, chemical and/or electrical properties. More specifically, these properties can include pressure, chemistry, flow, refractive index, specific conductivity, temperature, oxidation reduction potential, pH, and dissolved oxygen, as non-exclusive examples. The FBG sensor can measure a specific fluid property at multiple levels within the well 1212, multiple fluid properties each at a particular level within the well 1212, or multiple fluid properties each at a multiple levels within the well 1212.

In this embodiment, the FBG sensor can be positioned within the first zone 1226 and/or the second zone 1228. Stated another way, the FBG sensor can monitor or measure fluid properties in an isolated environment (in the first zone 1226 when the docking apparatus 1250 is in the engaged position), or in a non-isolated environment (in the first zone 1226 and/or the second zone 1228 while the docking apparatus 1250 is in the disengaged position).

Figure 13:
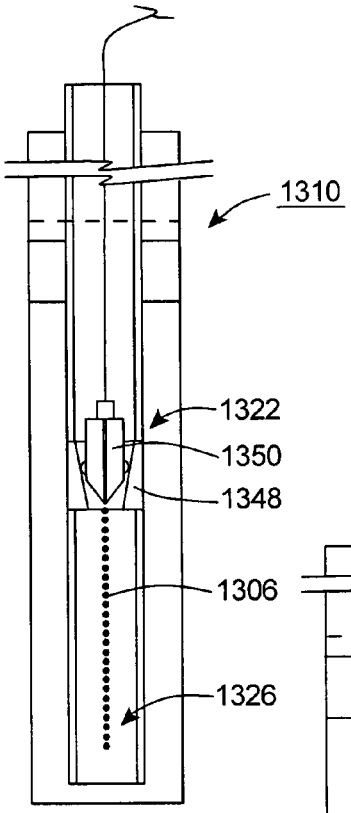
FIG. 13 is a schematic view of a portion of still another embodiment of the fluid monitoring system.

FIG. 13 is a schematic view of a portion of another embodiment of the fluid monitoring system 1310. In this embodiment, the zone isolation assembly 1322 includes the docking receiver 1348 and the docking apparatus 1350. However, one or both of the fluid collector 52 (illustrated in FIG. 1) and the pump assembly 54 (illustrated in FIG. 1) are omitted. Instead, the zone isolation assembly 1322 includes one or more of the fluid property sensors 1306 previously described. In this embodiment, the fluid property sensor 1306 is positioned within the first zone 1326 while the docking apparatus 1350 is in the engaged position. With this design, the fluid property sensor 1306 can monitor one or more fluid properties in an isolated fluid zone (the first zone 1326) and can communicate the required signals to the controller 17 (illustrated in FIG. 1) for further analysis, if necessary.

Figure 14A:
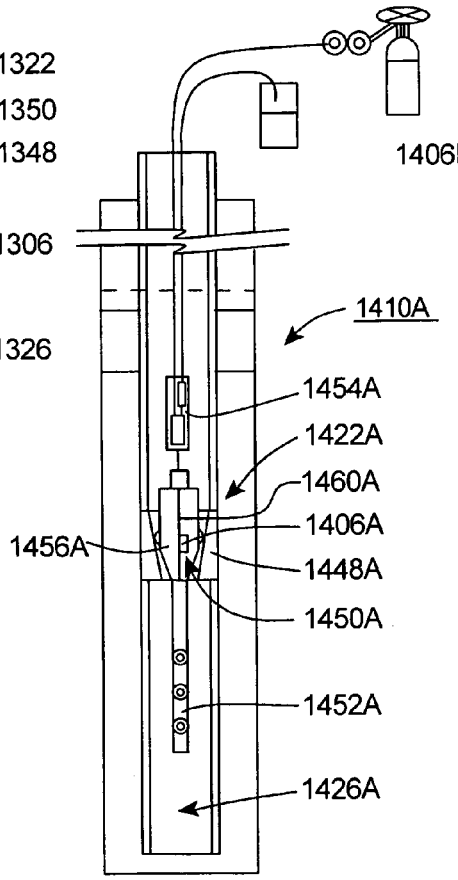
FIG. 14A is a schematic view of a portion of yet another embodiment of the fluid monitoring system.

FIG. 14A is a schematic view of a portion of yet another embodiment of the fluid monitoring system 1410A including the zone isolation assembly 1422A. In this embodiment, the zone isolation assembly 1422A includes the docking receiver 1448A, the docking apparatus 1450A, the fluid collector 1452A, and the pump assembly 1454A. The zone isolation assembly 1422A also includes one or more fluid property sensors 1406A for monitoring and/or measuring one or more fluid properties of the first fluid 38 (illustrated in FIG. 1) from the first zone 1426. In certain embodiments, the docking apparatus 1450A includes a fluid channel 1460A that can house the fluid property sensor(s) 1406A. The fluid property sensor 1406A can measure fluid properties during flow of the first fluid 38 from the first zone 1426A toward the surface region 32 (illustrated in FIG. 1) as previously described. In the embodiment illustrated in FIG. 14A, the fluid channel 1460A is substantially tubular. In this embodiment, the fluid channel 1460A can be generally centrally positioned within the docking weight 1456A so that the first fluid 38 flows substantially centrally through the docking weight 1456A.

Figure 14B:
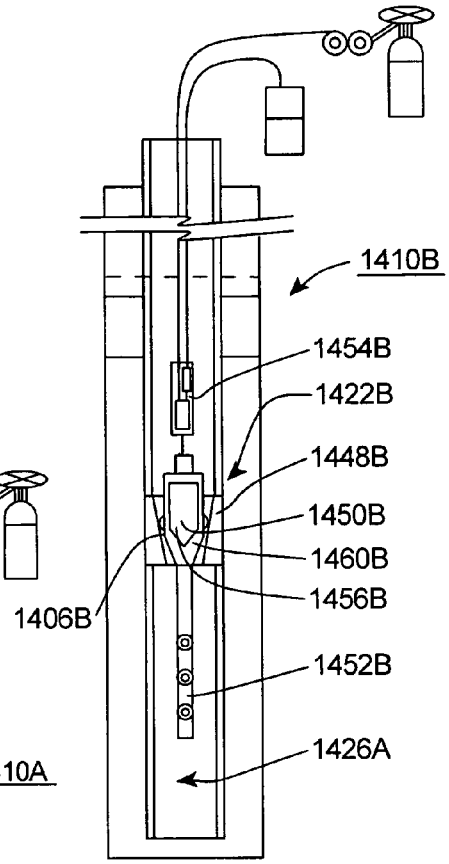
FIG. 14B is a schematic view of a portion of another embodiment of the fluid monitoring system.

FIG. 14B is a schematic view of a portion of yet another embodiment of the fluid monitoring system 1410B including the zone isolation assembly 1422B. In this embodiment, the zone isolation assembly 1422B includes the docking receiver 1448B, the docking apparatus 1450B, the fluid collector 1452B, and the pump assembly 1454B. The zone isolation assembly 1422B can also include one or more fluid property sensors 1406B for monitoring and/or measuring one or more fluid properties of the first fluid 38 (illustrated in FIG. 1). In this embodiment, each fluid property sensor 1406B can be positioned within one or more fluid channels 1460B positioned non-centrally on the docking weight 1456B. In the embodiment illustrated in FIG. 14B, for example, one or more fluid channels 1460B can be positioned near a periphery of the docking weight 1456B. With these designs, in situ fluid properties can be measured under dynamically induced flow conditions.

Figure 15A:
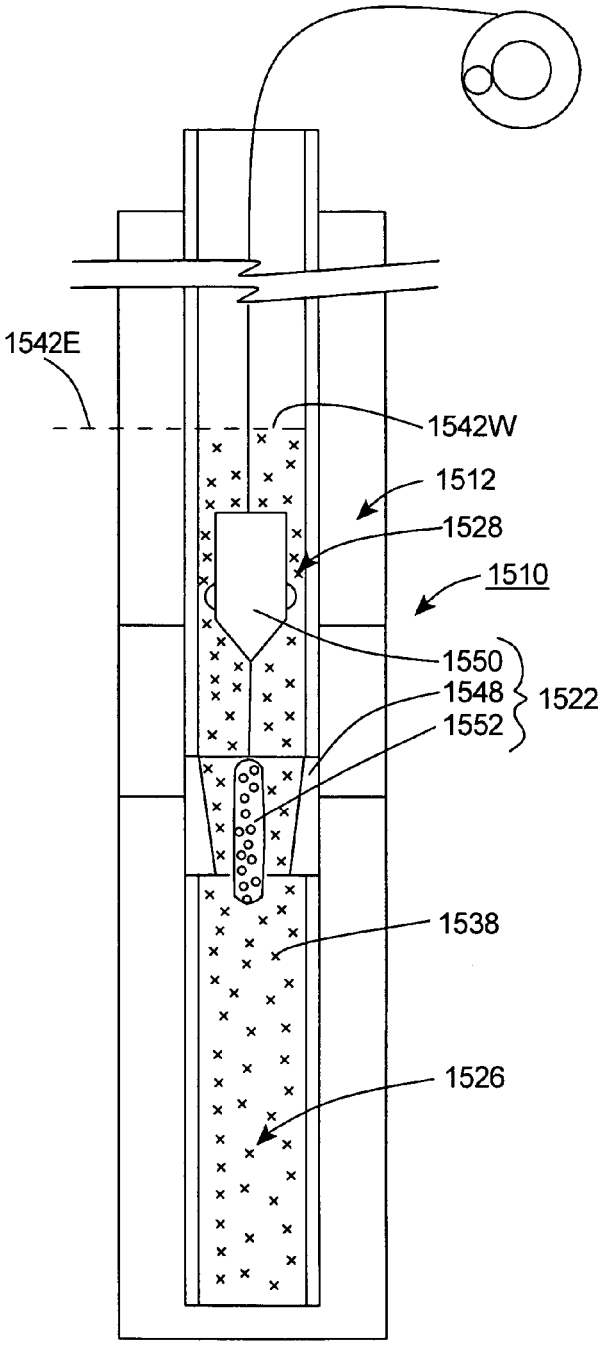
FIG. 15A is a schematic view of a portion of one embodiment of the fluid monitoring system including the zone isolation assembly with the docking apparatus illustrated in the disengaged position.
Figure 15B:
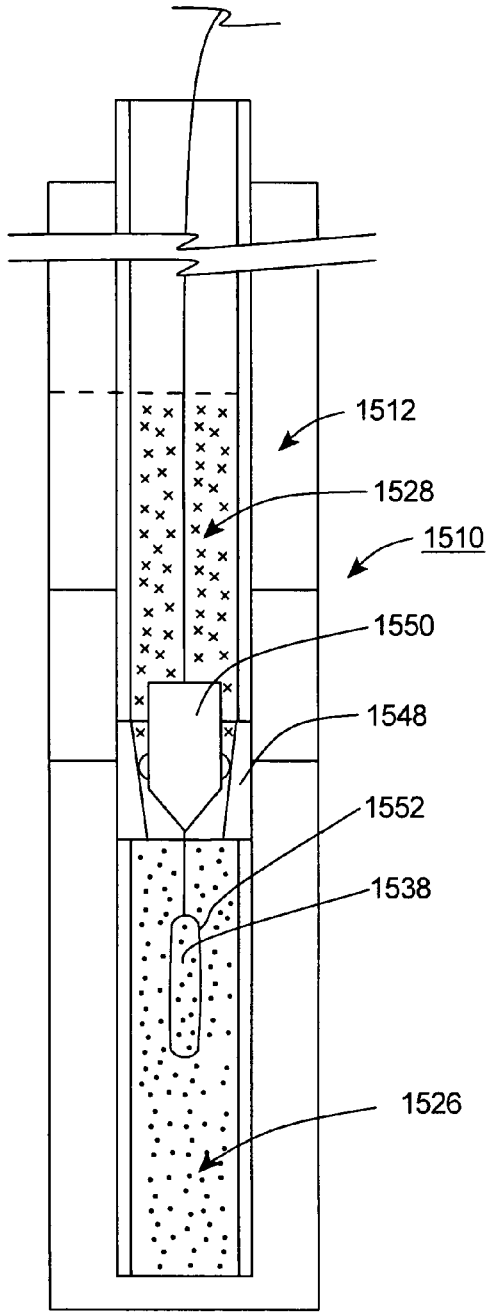
FIG. 15B is a schematic view of a portion of the fluid monitoring system illustrated in FIG. 15A, including the zone isolation assembly with the docking apparatus illustrated in the engaged position.

FIGS. 15A and 15B are schematic views of a portion of another embodiment of the fluid monitoring system 1510 including the zone isolation assembly 1522, illustrated in the disengaged position and the engaged position, respectively. In this embodiment, the zone isolation assembly 1522 includes the docking receiver 1548, the docking apparatus 1550 and the fluid collector 1552, which is coupled to the docking apparatus 1550. Moreover, the docking apparatus 1550 does not require a fluid channel 60 (illustrated in FIG. 1), as explained below. Further, in this embodiment, the pump assembly 54 (illustrated in FIG. 1) is unnecessary as described below.

In this embodiment, the fluid collector 1552 is a passive diffusion sampler, such as a passive diffusion bag. In one embodiment, the passive diffusion sampler 1552 can be formed from materials such as a low-density polyethylene lay-flat tubing bags that are filled with distilled and/or deionized water (indicated as O's in FIG. 15A) and then heat sealed at both ends. The passive diffusion sampler 1552 is lowered into the first zone 1526 of the well 1512 where it is allowed to equilibrate with the first fluid 1538 in the first zone 1526.

Before the docking apparatus 1550 is in the engaged position, the fluid (indicated by X's in FIG. 15A) in the well 1512 can rise to the well fluid level 1542W, in equilibrium with the environmental fluid level 1542E. It is recognized that in a relatively tall column of fluid such as in the well 1512, the composition of the fluid in the first zone 1526 will likely be different than that in the second zone 1528. Once the docking apparatus 1550 is in the engaged position, over time the first fluid 1538 in the first zone 1526 will change as fluid from the environment 11 continues to equilibrate with the fluid in the first zone 1526.

The passive diffusion sampler 1552 is allowed a predetermined time period (approximately 2 or 3 weeks in one non-exclusive example) within the isolated first zone 1526 to equilibrate with the first fluid 1538 in the first zone 1526. With this design, isolation of the passive diffusion sampler 1552 within the first zone 1526 reduces or eliminates diffusion-based averaging effects from the second zone 1528 on VOC concentrations. Additionally, passive diffusion bags are relatively inexpensive in comparison to pump assemblies and other pumping devices. Because a pump assembly is not necessary for use with passive diffusion samplers 1552, the cost of this type of system is reduced.

After the predetermined time period, the passive diffusion sampler 1552 is removed from the well 1512. The first fluid 1538 (indicated as dots in FIG. 15B) in the passive diffusion sampler 1552 is then analyzed as needed.

Figure 16A:
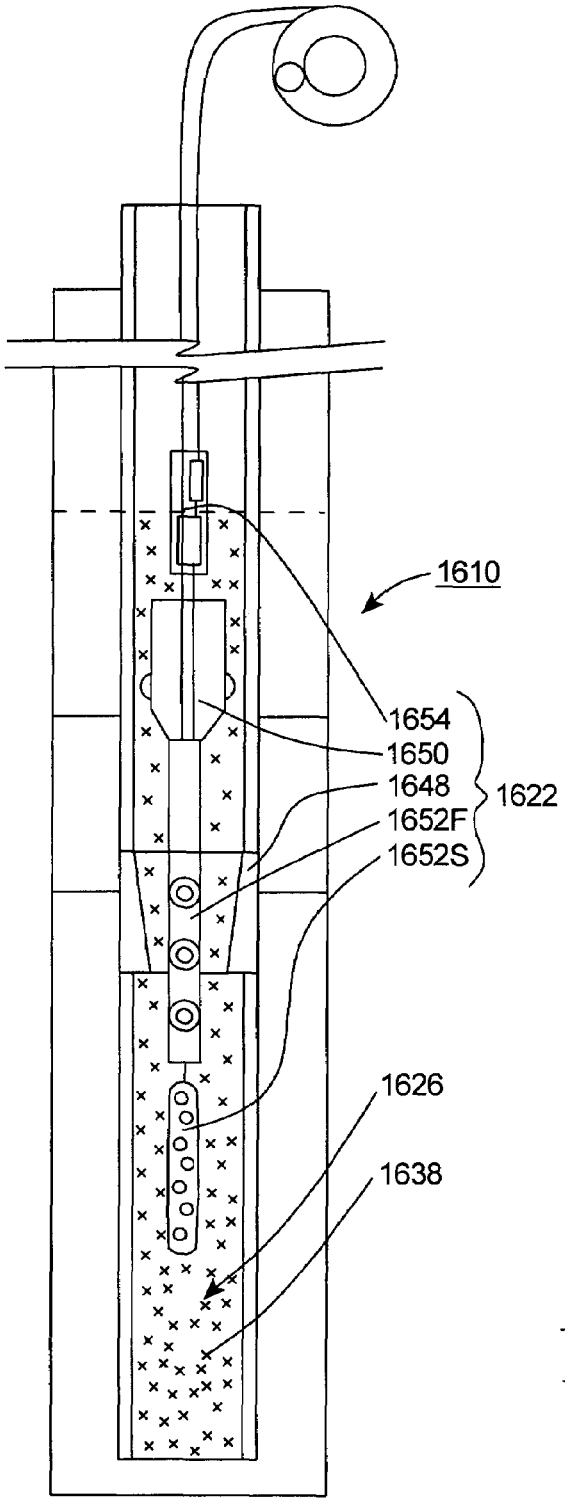
FIG. 16A is a schematic view of a portion of another embodiment of the fluid monitoring system including the zone isolation assembly with the docking apparatus illustrated in the disengaged position.
Figure 16B:
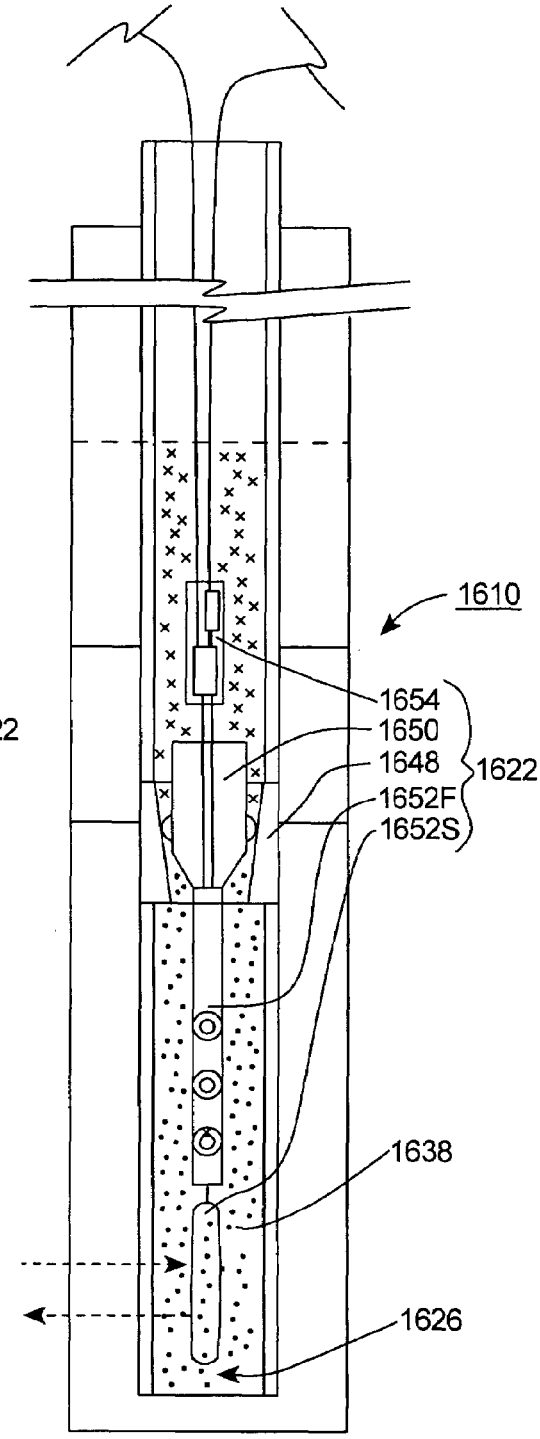
FIG. 16B is a schematic view of a portion of the fluid monitoring system illustrated in FIG. 16A, including the zone isolation assembly with the docking apparatus illustrated in the engaged position.

FIGS. 16A and 16B are schematic views of a portion of another embodiment of the fluid monitoring system 1610 including the zone isolation assembly 1622, illustrated in the disengaged position and the engaged position, respectively. In this embodiment, the zone isolation assembly 1622 includes the docking receiver 1648, the docking apparatus 1650, a first fluid collector 1652F, a second fluid collector 1652S and the pump assembly 1654. In one such embodiment, the second fluid collector 1652S can be a passive diffusion sampler, as previously described. With this design, concurrent deployment of the pump assembly 1654 and the first fluid collector 1652F on the one hand, and the second fluid collector 1652S on the other hand, permits comparability studies of the first fluid 1638 as a function of time within an isolated first zone 1626.

Figure 17A:
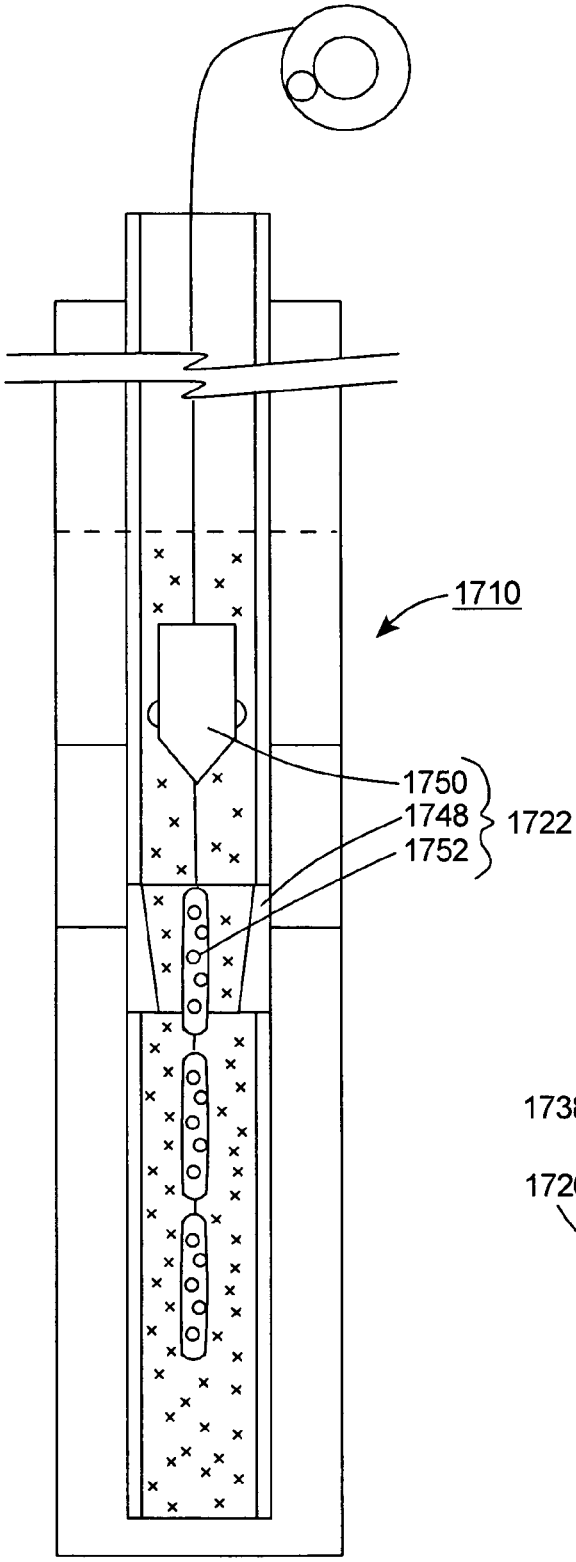
FIG. 17A is a schematic view of a portion of yet another embodiment of the fluid monitoring system including the zone isolation assembly with the docking apparatus illustrated in the disengaged position.
Figure 17B:
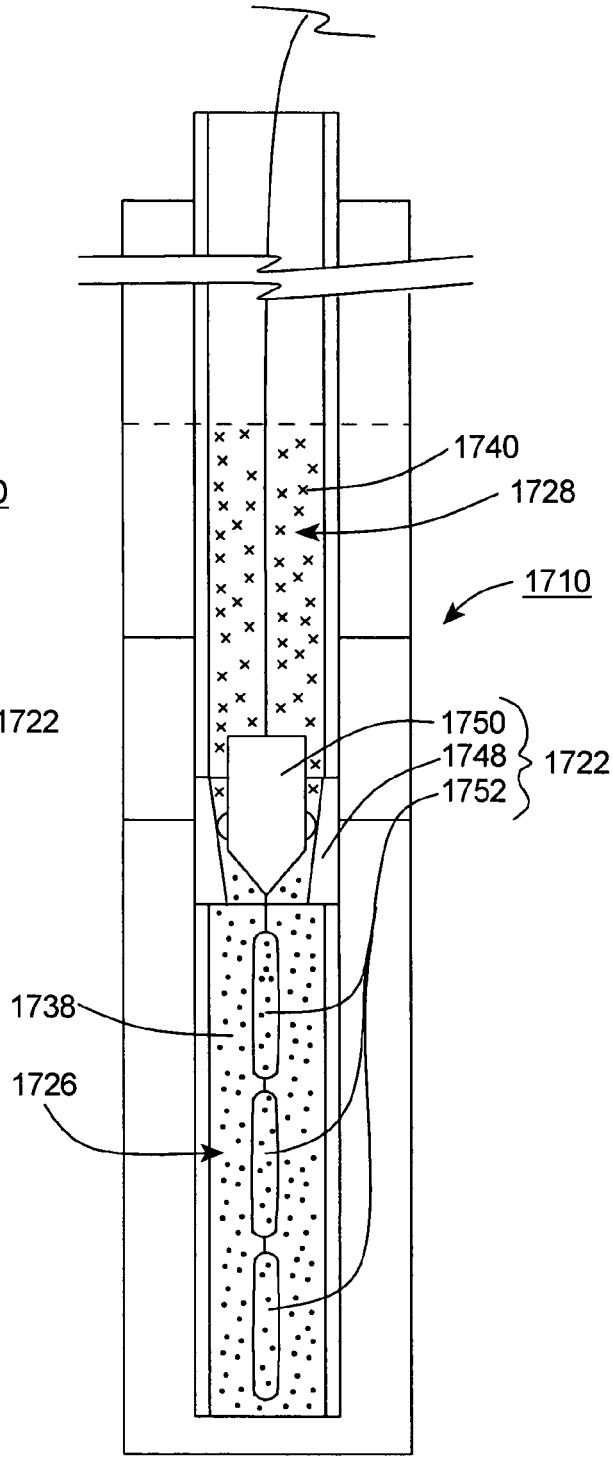
FIG. 17B is a schematic view of a portion of the fluid monitoring system illustrated in FIG. 17A, including the zone isolation assembly with the docking apparatus illustrated in the engaged position.

FIGS. 17A and 17B are schematic views of a portion of another embodiment of the fluid monitoring system 1710 including the zone isolation assembly 1722, illustrated in the disengaged position and the engaged position, respectively. In this embodiment, the zone isolation assembly 1722 includes the docking receiver 1748, the docking apparatus 1750 and a plurality of fluid collectors 1752, which are coupled to the docking apparatus 1750. Moreover, the docking apparatus 1750 does not require a fluid channel 60 (illustrated in FIG. 1), as explained below. Further, in this embodiment, the pump assembly 54 (illustrated in FIG. 1) is unnecessary as described below.

In this embodiment, the fluid collectors 1752 are a plurality of passive diffusion samplers, such as a chain of the passive diffusion bags previously described. With this design, subtle or moderate changes in fluid chemistry with depth can be monitored in the first fluid 1738 (indicated as dots in FIG. 17B) from the isolated first zone 1726 without any significant interference of diffusion averaging effects from the second fluid 1740 (indicated as X's in FIG. 17B) in the second zone 1728.

Figure 18A:
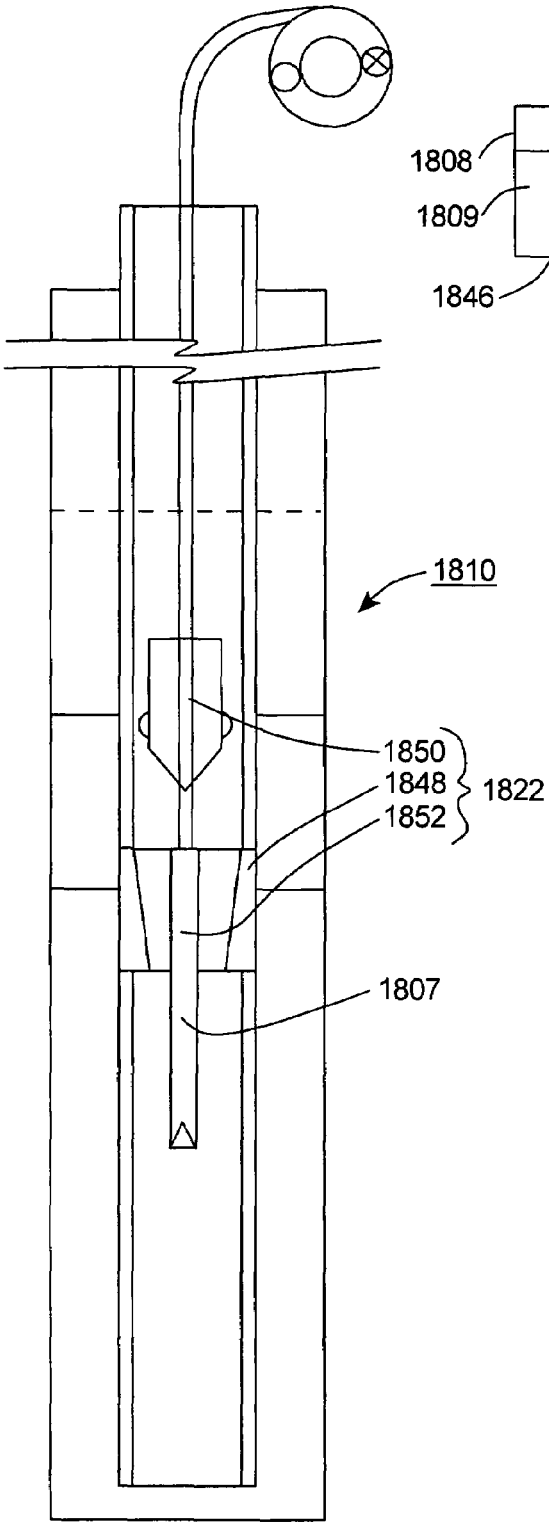
FIG. 18A is a schematic view of a portion of still another embodiment of the fluid monitoring system including the zone isolation assembly with the docking apparatus illustrated in the disengaged position.
Figure 18B:
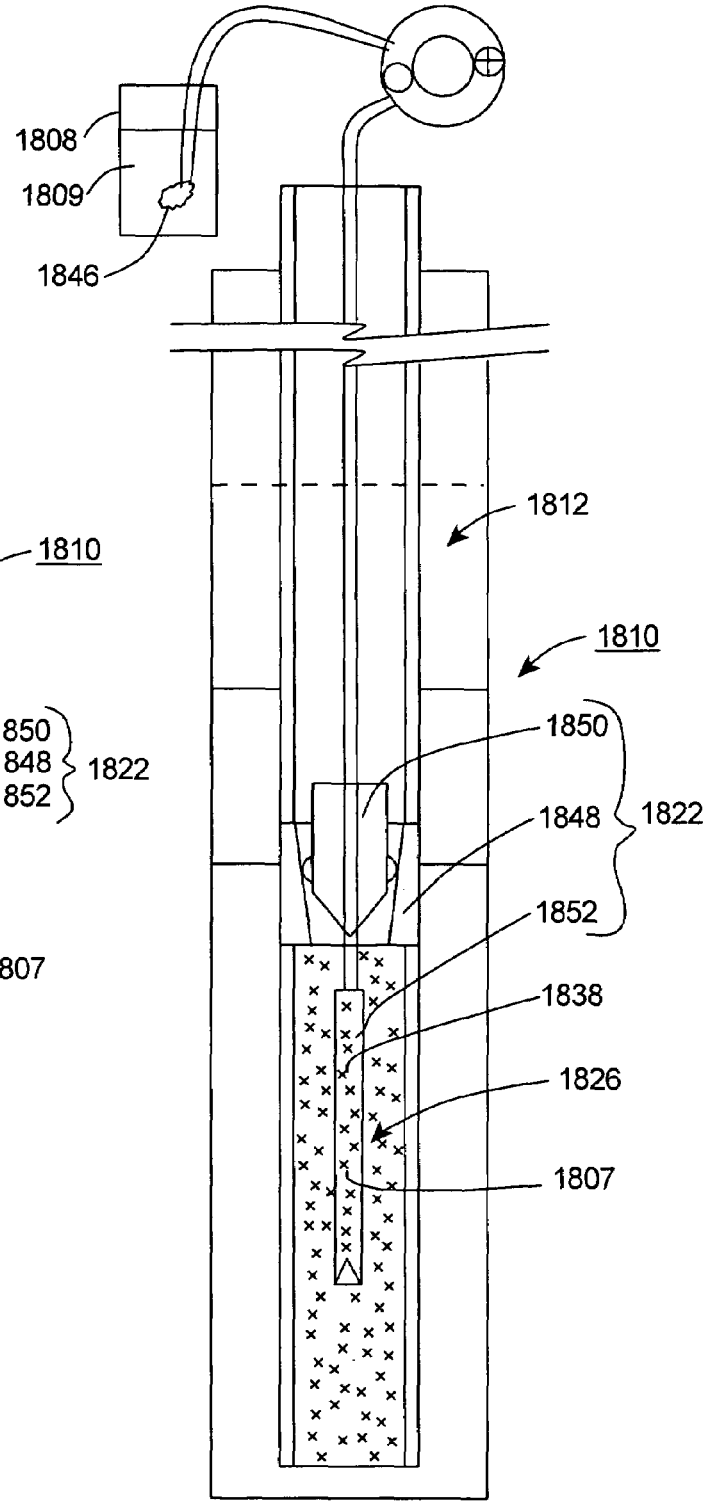
FIG. 18B is a schematic view of a portion of the fluid monitoring system illustrated in FIG. 18A, including the zone isolation assembly with the docking apparatus illustrated in the engaged position.

FIGS. 18A and 18B are schematic views of a portion of another embodiment of the fluid monitoring system 1810 including the zone isolation assembly 1822, illustrated in the disengaged position and the engaged position, respectively. In this embodiment, the zone isolation assembly 1822 includes the docking receiver 1848, the docking apparatus 1850 and fluid collector 1852, which is coupled to the docking apparatus 1850. Further, in this embodiment, the pump assembly 54 (illustrated in FIG. 1) is unnecessary as described below.

In this embodiment, the fluid collector 1852 is a pressurizable bailer. In one embodiment, the bailer 1852 includes a one-way valve 1807 that closes when the bailer 1852 is pressurized and opens when the bailer 1852 is unpressurized. Alternatively, the bailer 1852 can be non-pressurized. In the case of the pressurized bailer 1852, a gas source 14 (illustrated in FIG. 1) provides a gas 46 (illustrated in FIG. 1) to the bailer 1852 during lowering of the docking apparatus 1850 and the bailer 1852 toward the first zone 1826 (FIG. 18A).

Once the docking apparatus 1850 is in the engaged position (FIG. 18B), the pressure within the bailer can be released to allow the first fluid 1838 (indicated by X's in FIG. 18B) from the first zone 1826 to fill the bailer 1852. The gas 1846 moves from the bailer 1852 to a gas receiver 1808 positioned outside of the well 1812. The gas receiver 1808 includes a liquid 1809 (such as water or another suitable liquid), which bubbles as the gas 1846 from the bailer 1852 is received in the gas receiver 1808. Once the bubbling stops, the bailer 1852 has been filled with the first fluid 1838, and the bailer 1852 can be repressurized and retrieved from the well 1812 for analysis of the first fluid 1838.

Figure 19:
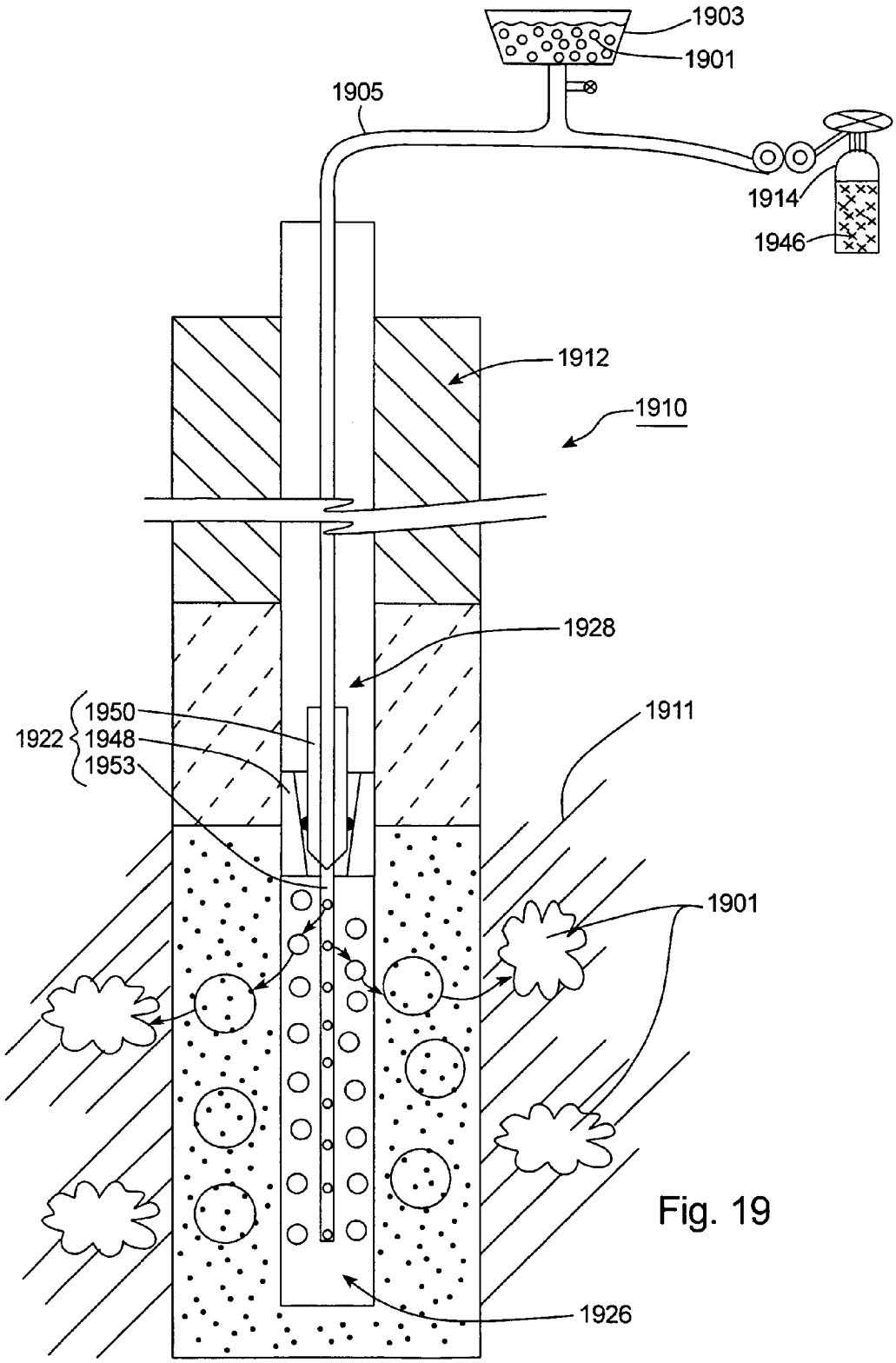
FIG. 19 is a schematic view of a portion of yet another embodiment of the fluid monitoring system.

FIG. 19 is a schematic view of a portion of yet another embodiment of the fluid monitoring system 1910 including the zone isolation assembly 1922. In one embodiment, the zone isolation assembly 1922 includes the docking receiver 1948, the docking apparatus 1950, and a fluid disperser 1953. As provided herein, the fluid monitoring system 1910 illustrated in FIG. 19 can be used to inject or otherwise disperse a dispersion fluid 1901 into the environment 1911 surrounding the well 1912 for remediation purposes or any other suitable purpose. The fluid disperser 1953 can be perforated or can have any other type of openings that allow the dispersion fluid 1901 to move from the fluid disperser to the first zone 1926.

In one embodiment, the fluid monitoring system 1910 also includes a dispersion fluid retainer 1903 that retains the dispersion fluid 1901, a gas supply 1914 that supplies a gas 1946, and a fluid inlet line 1905 that is coupled to the docking apparatus 1950. The fluid inlet line 1905 can be formed from any suitable material that is compatible with the type of dispersion fluid 1901 to be used in the system 1910. For example, the fluid inlet line 1905 can be formed from various plastics, metal, fiberglass, ceramic, etc. The dispersion fluid retainer 1903 can selectively release the dispersion fluid 1901 into the fluid inlet line 1905 as needed. The gas supply 1914 can be opened to forcibly move the gas 1946 through the fluid inlet line 1905, which in turn forces the dispersion fluid 1901 downward and through the docking apparatus 1950 into the first zone 1926 via the fluid disperser 1953 while the docking apparatus 1950 is in the engaged position. In the engaged position, the zone isolation assembly 1922 isolates the dispersion fluid 1901 within the first zone 1926, while inhibiting the dispersion fluid 1901 from moving into the second zone 1928.

In this embodiment, the type of dispersion fluid 1901 used can vary depending upon the type of remediation that is necessary in the environment 1911. The dispersion fluid 1901 can include air, oxidizers, reducers, various bacteria, potassium permanganate, or any other suitable chemicals, either in liquid or gas form. The fluid monitoring system 1910 illustrated in FIG. 19 can be used in a well 1912 that contains liquid, gas, or both liquid and gas.

In an alternative embodiment (not shown), the perforated fluid disperser 1953 can be omitted, and the dispersion fluid 1901 can enter the first zone 1926 immediately after passing through the docking apparatus 1950 via the fluid inlet line 1905.

Figure 20:
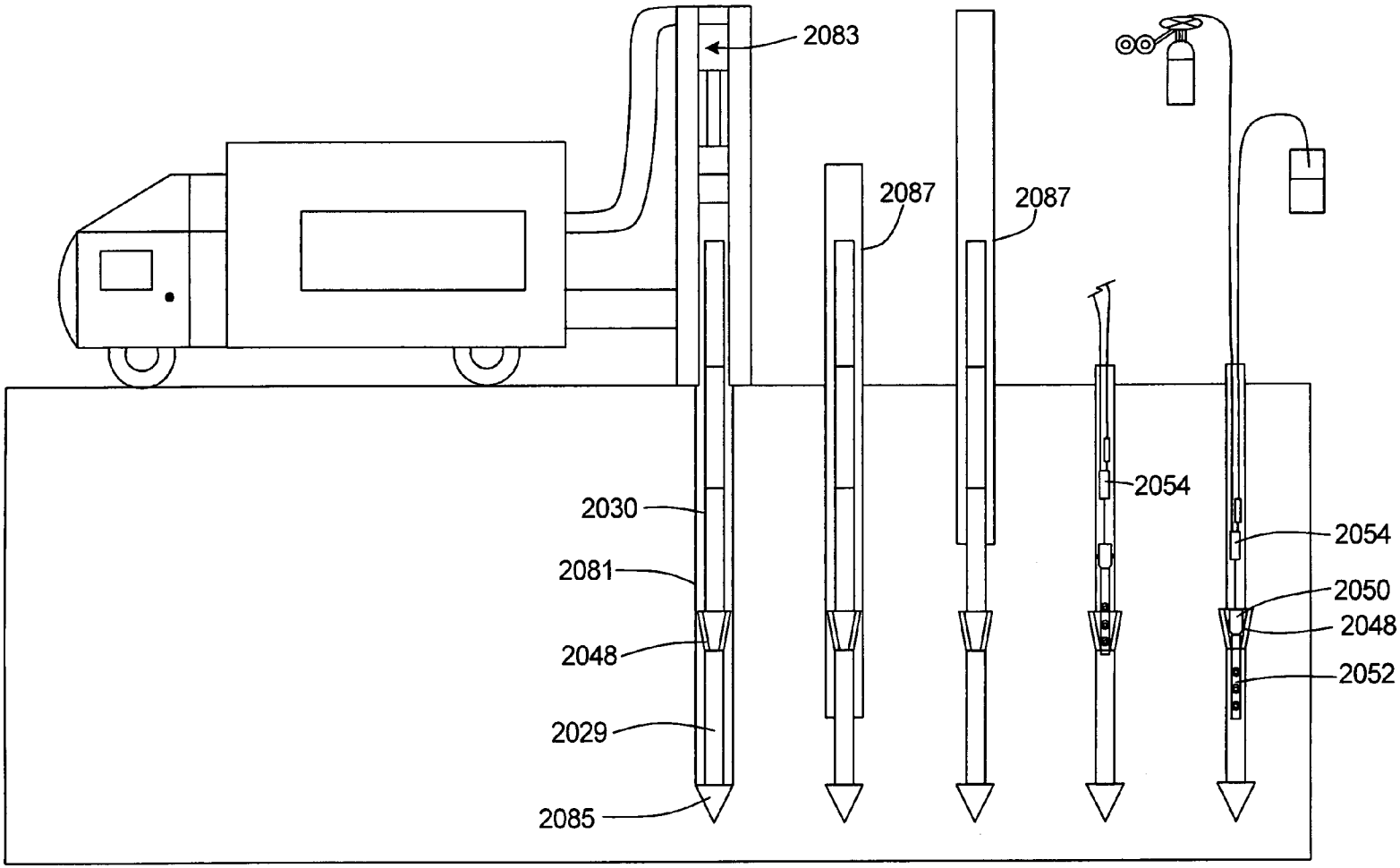
FIG. 20 is a schematic illustration of a process for installation of one embodiment of the fluid monitoring system.

As indicated previously, the fluid monitoring systems provided herein can be installed by a variety of different methods. FIG. 20 illustrates one embodiment of a process for installation of the fluid monitoring system into the ground. In the embodiment illustrated in FIG. 20, a drive casing 2081 can incrementally be advanced in sections (not shown) equal to the length of each drive casing length (i.e. 5-foot or 10-foot sections). In one embodiment, a bottom section of the drive casing 2081 including a drive cone 2085 can be loaded with the fluid inlet structure 2029, the docking receiver 2048 and a section of riser pipe 2030 that is somewhat shorter than the drive casing 2081. Before each new drive casing length is attached, a new section of riser pipe 2030 is first attached.

The new length or section of drive casing 2081 is then lowered over the new section of riser pipe 2030 and threaded to secure attachment—with the drive casing 2081 rising slightly higher than the riser pipe 2030. A percussion cap (not shown) can be placed over the top of the drive casing 2081. A drive hammer 2083 or hydraulic ram can be used to vertically advance the drive casing 2081, with the riser pipe 2030 passively advancing along with the drive casing 2081.

When total depth is reached, the drive casing 2081 is retracted (retraction indicated by two steps 2087). With the drive cone 2085 attached to the bottom of the fluid inlet structure 2029, the drive cone 2085 remains at the bottom of the borehole while the drive casing 2081 is retracted. After the drive casing 2081 is fully removed from the borehole, the top section of riser pipe 2030 can remain for above-ground completions, or can be removed for flush mounted surface completions. The docking apparatus 2050, the fluid collector 2052 and/or a pump assembly 2054 can be inserted inside the direct push well 2012 for collecting the first fluid 38 (illustrated in FIG. 1) as described herein.

It is recognized that the various embodiments illustrated and described herein are representative of various combinations of features that can be included in the fluid monitoring system 10 and the zone isolation assemblies 22. However, numerous other embodiments have not been illustrated and described as it would be impractical to provide all such possible embodiments herein. It is to be understood that an embodiment of the zone isolation assembly 22 can include any of the docking receivers 48, docking apparatuses 50, fluid collectors 52, pump assemblies 54, and any of the other structures described herein depending upon the design requirements of the fluid monitoring system 10 and/or the subsurface well 12, and that no limitations are intended by not specifically illustrating and describing any particular embodiment.

Further, it is recognized that a well array of a plurality of subsurface wells 12 can be installed in a single borehole. For example, from 2-24 subsurface wells 12, also referred to as nested wells 12, can be installed in a borehole so that the zone isolation assembly 22 of each well 12 is positioned at two or more different depths within a given borehole. With this design, zones from different depths can be isolated to simultaneously monitor and/or analyze fluid properties from these different depths.

The arrangement of each well array can vary. For instance, the wells 12 can be arranged in a circle within the borehole. Alternatively, the wells 12 can utilize a different pattern or a random configuration within the borehole. Moreover, each well 12 in this type of system can utilize substantially similar or identical zone isolation assemblies 22, or each well can utilize any two or more different zone isolation assemblies 22 described herein.

While the particular fluid monitoring systems 10 and zone isolation assemblies 22 as herein shown and disclosed in detail are fully capable of obtaining the objects and providing the advantages herein before stated, it is to be understood that they are merely illustrative of various embodiments of the invention. No limitations are intended to the details of construction or design herein shown other than as described in the appended claims.

What is claimed is:

1. A zone isolation assembly for a subsurface well that extends downward from a surface region, the subsurface well including (i) a first fluid inlet structure that at least partially defines a first zone that receives a first fluid, and (ii) a second zone that is nearer to the surface region than the first zone, the zone isolation assembly comprising:

a fixed docking receiver that is coupled to the first fluid inlet structure, the docking receiver at least partially defining the first zone; and a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone, the docking apparatus including an O-ring that forms a substantially fluid-tight seal with the docking receiver when the docking apparatus is in the engaged position, the docking apparatus being maintained in the engaged position substantially by the force of gravity.

2. The zone isolation assembly of claim 1 wherein the first zone is not substantially in fluid communication with the second zone during movement of the first fluid between the first zone and the surface region.

3. The zone isolation assembly of claim 1 further comprising a pump assembly that pumps the first fluid toward the surface region while the docking apparatus is in the engaged position.

4. The zone isolation assembly of claim 1 further comprising a fluid collector that is positioned within the first zone while the docking apparatus is in the engaged position, the fluid collector collecting the first fluid for transport to the surface region while the docking apparatus is in the engaged position.

5. The zone isolation assembly of claim 1 wherein the first zone is not substantially in fluid communication with the second zone during movement of the first fluid between the first zone and the surface region.

6. The zone isolation assembly of claim 1 wherein the docking receiver defines at least a portion of the second zone.

7. The zone isolation assembly of claim 1 wherein the subsurface well includes a second fluid inlet structure that allows a second fluid to enter the second zone without contacting the first fluid when the docking apparatus is in the engaged position.

8. A fluid monitoring system including the zone isolation assembly of claim 1 and a fluid property sensor positioned within the subsurface well, the fluid property sensor sensing a fluid property selected from the group consisting of an electrical property, a chemical property and a hydraulic property.

9. A zone isolation assembly for a subsurface well that extends downward from a surface region, the subsurface well including (i) a first fluid inlet structure that at least partially defines a first zone that receives a first fluid, (ii) a second zone that is nearer to the surface region than the first zone, and (iii) a riser pipe that at least partially defines the second zone, the zone isolation assembly comprising:

a fixed docking receiver that is coupled to the first fluid inlet structure, the docking receiver at least partially defining the first zone; and a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone during movement of the first fluid between the first zone and the surface region;

wherein in the engaged position, a surface area of the docking apparatus that is in contact with the docking receiver is less than approximately 1.0 $in^2$ when the riser pipe has an outer diameter of at least approximately one inch.

10. A zone isolation assembly for a subsurface well that extends downward from a surface region, the subsurface well including (i) a first fluid inlet structure that at least partially defines a first zone that receives a first fluid, and (ii) a second zone that is nearer to the surface region than the first zone, the zone isolation assembly comprising:

a fixed docking receiver that is coupled to the first fluid inlet structure, the docking receiver at least partially defining the first zone; and a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone during movement of the first fluid between the first zone and the surface region, the docking apparatus including an O-ring formed from a rubber material, the O-ring forming a substantially fluid-tight seal with the docking receiver when the docking apparatus is in the engaged position so that the first zone not in fluid communication with the second zone.

11. The zone isolation assembly of claim 10 further comprising a pump assembly that is coupled to the docking apparatus, the pump assembly pumping the first fluid toward the surface region while the docking apparatus is in the engaged position.

12. The zone isolation assembly of claim 11 wherein the pump assembly is positioned substantially within the first zone while the docking apparatus is in the engaged position.

13. The zone isolation assembly of claim 11 wherein the pump assembly is positioned substantially within the second zone while the docking apparatus is in the engaged position.

14. The zone isolation assembly of claim 11 wherein the subsurface well includes a riser pipe that at least partially defines the second zone, and wherein the pump assembly is removable from the riser pipe.

15. The zone isolation assembly of claim 14 wherein the riser pipe is not pressurized during pumping of the first fluid with the pump assembly.

16. The zone isolation assembly of claim 11 wherein the pump assembly is bladderless.

17. The zone isolation assembly of claim 11 further comprising a gas inlet line that guides movement of a gas to the pump assembly, and a fluid outlet line that guides movement of the first fluid toward the surface region, wherein the gas does not contact the first fluid while the first fluid is in the fluid outlet line.

18. The zone isolation assembly of claim 11 wherein the pump assembly includes two spaced-apart one-way valves.

19. The zone isolation assembly of claim 10 further comprising a fluid collector that is coupled to the docking apparatus, the fluid collector collecting the first fluid for transport to the surface region.

20. The zone isolation assembly of claim 19 wherein the fluid collector is positioned within the first zone during collection of the portion of the first fluid.

21. The zone isolation assembly of claim 20 wherein the fluid collector includes a perforated sipping tube.

22. The zone isolation assembly of claim 20 wherein the fluid collector includes a passive diffusion sampling apparatus.

23. The zone isolation assembly of claim 20 wherein the fluid collector includes a pressurizable bailer.

24. The zone isolation assembly of claim 10 wherein a portion of the docking apparatus has a frusto-conical configuration that is received by the docking receiver when the docking apparatus is in the engaged position.

25. The zone isolation assembly of claim 10 wherein the docking receiver defines at least a portion of the second zone.

26. The zone isolation assembly of claim 10 wherein the subsurface well includes a fluid inlet structure that allows a second fluid to enter the second zone without contacting the first fluid when the docking apparatus is in the engaged position.

27. The zone isolation assembly of claim 10 wherein the first fluid is a liquid.

28. The zone isolation assembly of claim 10 wherein the first fluid is a gas.

29. The zone isolation assembly of claim 10 further comprising a substantially fluid-tight manifold that selectively inhibits a fluid from entering into the second zone through the surface region.

30. The zone isolation assembly of claim 10 wherein the first zone has a first diameter and the second zone has a second diameter that is substantially similar to the first diameter.

31. The zone isolation assembly of claim 10 wherein the subsurface well includes a riser pipe that at least partially defines the second zone, the riser pipe being threadedly secured to the docking receiver.

32. The zone isolation assembly of claim 10 wherein the docking apparatus has a specific gravity of at least approximately 2.00.

33. The zone isolation assembly of claim 10 further comprising a fluid disperser that is at least partially positioned in the first zone, the fluid disperser dispersing a dispersion fluid from the surface region into the first zone while the docking apparatus is in the engaged position.

34. The zone isolation assembly of claim 10 wherein in the engaged position, the first zone is not in fluid communication with the second zone during movement of the first fluid from the surface region to the first zone.

35. The zone isolation assembly of claim 10 wherein in the engaged position, the first zone is not in fluid communication with the second zone during movement of the first fluid from the first zone to the surface region.

36. A fluid monitoring system including the zone isolation assembly of claim 10 and a fluid property sensor positioned within the subsurface well, the fluid property sensor sensing a fluid property selected from the group consisting of an electrical property, a chemical property and a hydraulic property.

37. The fluid monitoring system of claim 36 wherein the fluid property sensor is at least partially positioned within the first zone when the docking apparatus is in the engaged position.

38. The fluid monitoring system of claim 36 wherein the fluid property sensor includes a Fiber Bragg Grating sensor.

39. A zone isolation assembly for a subsurface well that extends downward from a surface region, the subsurface well including (i) a first fluid inlet structure that at least partially defines a first zone that receives a first fluid, the first zone having a first diameter, and (ii) a second zone that is nearer to the surface region than the first zone, the second zone having a second diameter that is substantially similar to the first diameter, the zone isolation assembly comprising:

a fixed docking receiver that is coupled to the first fluid inlet structure, the docking receiver at least partially defining the first zone; and a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone during movement of the first fluid between the first zone and the surface region.

40. A zone isolation assembly for a subsurface well that extends downward from a surface region, the subsurface well including (i) a first fluid inlet structure that at least partially defines a first zone that receives a first fluid, (ii) a second zone that is nearer to the surface region than the first zone, and (iii) a riser pipe that at least partially defines the second zone, the zone isolation assembly comprising:

a fixed docking receiver that is coupled to the first fluid inlet structure, the docking receiver being threadedly secured to the riser pipe, the docking receiver at least partially defining the first zone; and a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone during movement of the first fluid between the first zone and the surface region.

41. The zone isolation assembly of claim 40 wherein the docking apparatus is maintained in the engaged position substantially by a force of gravity.

42. The zone isolation assembly of claim 40 wherein the docking apparatus includes a resilient seal that forms a substantially fluid-tight seal with the docking receiver when the docking apparatus is in the engaged position so that the first zone is not in fluid communication with the second zone.

43. The zone isolation assembly of claim 42 wherein the resilient seal is an O-ring formed from a rubber material.

44. The zone isolation assembly of claim 42 wherein the resilient seal contacts the docking receiver with a force that is less than approximately 1.00 psi when the docking apparatus is in the engaged position.

45. The zone isolation assembly of claim 40 further comprising a pump assembly that pumps the first fluid toward the surface region while the docking apparatus is in the engaged position.

46. The zone isolation assembly of claim 45 further comprising a gas inlet line that guides movement of a gas to the pump assembly, and a fluid outlet line that guides movement of the first fluid toward the surface region, wherein the gas does not contact the first fluid while the first fluid is in the fluid outlet line.

47. The zone isolation assembly of claim 40 wherein the docking receiver defines at least a portion of the second zone.

48. A zone isolation assembly for a subsurface well that extends downward from a surface region, the subsurface well including (i) a first fluid inlet structure that at least partially defines a first zone that receives a first fluid, and (ii) a second zone that is nearer to the surface region than the first zone, the zone isolation assembly comprising:

a fixed docking receiver that is coupled to the first fluid inlet structure, the docking receiver at least partially defining the first zone;

a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone during movement of the first fluid between the first zone and the surface region; and a fluid disperser that is at least partially positioned in the first zone, the fluid disperser dispersing a dispersion fluid from the surface region into the first zone while the docking apparatus is in the engaged position.

49. A zone isolation assembly for a subsurface well having a riser pipe that extends downward from a surface region, the subsurface well including (i) a first fluid inlet structure that at least partially defines a first zone that receives a first fluid, and (ii) a second zone that is nearer to the surface region than the first zone, the zone isolation assembly comprising:

a fixed docking receiver that is coupled to the first fluid inlet structure, the docking receiver at least partially defining the first zone;

a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone;

a pump assembly that pumps the first fluid toward the surface region while the docking apparatus is in the engaged position;

a gas inlet line that guides movement of a gas to the pump assembly; and a fluid outlet line that guides movement of the first fluid toward the surface region, wherein the gas does not contact the first fluid while the first fluid is in the fluid outlet line.

50. The zone isolation assembly of claim 49 wherein the first zone is not substantially in fluid communication with the second zone during movement of the first fluid between the first zone and the surface region.

51. The zone isolation assembly of claim 49 further comprising a fluid collector that is positioned within the first zone while the docking apparatus is in the engaged position, the fluid collector collecting the first fluid for transport to the surface region while the docking apparatus is in the engaged position.

52. The zone isolation assembly of claim 51 wherein the fluid collector includes a perforated sipping tube.

53. The zone isolation assembly of claim 49 wherein the docking apparatus is maintained in the engaged position substantially by the force of gravity.

54. The zone isolation assembly of claim 49 wherein the pump assembly is positioned substantially within the first zone while the docking apparatus is in the engaged position.

55. The zone isolation assembly of claim 49 wherein the pump assembly is positioned substantially within the second zone while the docking apparatus is in the engaged position.

56. The zone isolation assembly of claim 49 wherein the subsurface well includes a riser pipe that at least partially defines the second zone, and wherein the pump assembly is removable from the riser pipe.

57. The zone isolation assembly of claim 56 wherein the riser pipe is not pressurized during pumping of the first fluid with the pump assembly.

58. The zone isolation assembly of claim 49 wherein the pump assembly includes two spaced-apart one-way valves.

59. The zone isolation assembly of claim 49 wherein the subsurface well includes a second fluid inlet structure that allows a second fluid to enter the second zone without contacting the first fluid when the docking apparatus is in the engaged position.

60. A fluid monitoring system including the zone isolation assembly of claim 49 and a fluid property sensor positioned within the subsurface well, the fluid property sensor sensing a fluid property selected from the group consisting of an electrical property, a chemical property and a hydraulic property.

61. A zone isolation assembly for a subsurface well having a riser pipe that extends downward from a surface region, the subsurface well including (i) a first fluid inlet structure that at least partially defines a first zone that receives a first fluid, and (ii) a second zone that is nearer to the surface region than the first zone, the zone isolation assembly comprising:

a fixed docking receiver that is coupled to the first fluid inlet structure, the docking receiver at least partially defining the first zone and a portion of the second zone;

a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone; and a pump assembly that pumps the first fluid toward the surface region while the docking apparatus is in the engaged position.

62. The zone isolation assembly of claim 61 wherein the first zone is not substantially in fluid communication with the second zone during movement of the first fluid between the first zone and the surface region.

63. The zone isolation assembly of claim 61 wherein the docking apparatus is maintained in the engaged position substantially by the force of gravity.

64. The zone isolation assembly of claim 61 wherein the docking receiver defines at least a portion of the second zone.

65. The zone isolation assembly of claim 61 wherein the subsurface well includes a first fluid inlet structure that allows the first fluid to enter the first zone, and a second fluid inlet structure that allows a second fluid to enter the second zone without contacting the first fluid when the docking apparatus is in the engaged position.

66. A fluid monitoring system including the zone isolation assembly of claim 61 and a fluid property sensor positioned within the subsurface well, the fluid property sensor sensing a fluid property selected from the group consisting of an electrical property, a chemical property and a hydraulic property.

67. A zone isolation assembly for a subsurface well that extends downward from a surface region, the subsurface well including (i) a first fluid inlet structure that at least partially defines a first zone that receives a first fluid, and (ii) a second zone that is nearer to the surface region than the first zone, the zone isolation assembly comprising:

a fixed docking receiver that is coupled to the first fluid inlet structure, the docking receiver at least partially defining the first zone and at least a portion of the second zone;

a docking apparatus that is selectively moved relative to the docking receiver between (i) a disengaged position wherein the first zone is in fluid communication with the second zone, and (ii) an engaged position wherein the docking apparatus engages the docking receiver so that the first zone is not substantially in fluid communication with the second zone during movement of the first fluid between the first zone and the surface region;

a pump assembly that pumps the first fluid toward the surface region while the docking apparatus is in the engaged position;

a gas inlet line that guides movement of a gas to the pump assembly; and a fluid outlet line that guides movement of the first fluid toward the surface region, wherein the gas does not contact the first fluid while the first fluid is in the fluid outlet line.

* * * * *

UNITED STATES PATENT AND TRADEMARK OFFICE

CERTIFICATE OF CORRECTION

PATENT NO. : 7,665,534 B2
APPLICATION NO. : 11/651900
DATED : February 23, 2010
INVENTOR(S) : Heller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 171 days.

Signed and Sealed this

Seventh Day of December, 2010

David J. Kappos

David J. Kappos
*Director of the United States Patent and Trademark Office*